US007896333B2

(12) United States Patent
Taki et al.

(10) Patent No.: US 7,896,333 B2
(45) Date of Patent: Mar. 1, 2011

(54) SHEET PROCESSING APPARATUS

(75) Inventors: Hiroyuki Taki, Shizuoka (JP); Yasunobu Terao, Shizuoka (JP); Toshiaki Oshiro, Shizuoka (JP); Yoshiaki Sugizaki, Shizuoka (JP); Mikio Yamamoto, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/140,467

(22) Filed: Jun. 17, 2008

(65) Prior Publication Data

US 2008/0315503 A1 Dec. 25, 2008

Related U.S. Application Data

(60) Provisional application No. 60/944,831, filed on Jun. 19, 2007, provisional application No. 60/944,959, filed on Jun. 19, 2007, provisional application No. 60/944,970, filed on Jun. 19, 2007, provisional application No. 60/944,971, filed on Jun. 19, 2007, provisional application No. 60/945,374, filed on Jun. 21, 2007.

(51) Int. Cl.
*B65H 33/04* (2006.01)
*B65H 39/00* (2006.01)

(52) U.S. Cl. ..... 270/58.12; 270/58.07; 270/58.08; 270/58.11; 270/58.17; 270/58.27

(58) Field of Classification Search ..... 270/58.07, 270/58.08, 58.11, 58.12, 58.17, 58.27
See application file for complete search history.

(56) References Cited

U.S. PATENT DOCUMENTS

| | | | | |
|---|---|---|---|---|
| 6,702,279 | B2 * | 3/2004 | Adachi et al. | 271/220 |
| 7,172,187 | B2 * | 2/2007 | Terao et al. | 270/58.08 |
| 7,192,020 | B2 * | 3/2007 | Hayashi et al. | 270/58.11 |
| 2004/0181308 | A1 | 9/2004 | Hayashi et al. | |

FOREIGN PATENT DOCUMENTS

| | | |
|---|---|---|
| JP | 07-048061 | 2/1995 |
| JP | 11-157741 | 6/1999 |
| JP | 11-301912 | 11/1999 |
| JP | 11301912 A * | 11/1999 |
| JP | 2002-072038 | 3/2002 |
| JP | 2002-114428 | 4/2002 |

* cited by examiner

*Primary Examiner*—Gene Crawford
*Assistant Examiner*—Yolanda Cumbess
(74) *Attorney, Agent, or Firm*—Turocy & Watson, LLP

(57) ABSTRACT

In a sheet processing apparatus that, for example, sorts or staples sheets after image formation, when preceding finishing is not completed on a processing tray, a third sheet fed anew into a waiting tray of a sheet placing member configuring a sheet waiting unit, which temporarily puts a sheet conveyed thereto on standby, is stacked to be shifted such that leading ends of second and third sheets are located further on a conveying direction upstream side than a leading end of a first sheet. Consequently, longitudinal alignment in the processing tray after that is surely performed.

14 Claims, 27 Drawing Sheets

SHEET PROCESSING APPARATUS

CROSS-REFERENCE TO RELATED APPLICATION

This application is based upon and claims the benefit of priority from the prior provisional Patent Applications No. 60/944,831, filed on Jun. 19, 2007, No. 60/944,959, filed on Jun. 19, 2007, No. 60/944,970, filed on Jun. 19, 2007, No. 60/944,971, filed on Jun. 19, 2007, and No. 60/945,374, filed on Jun. 21, 2007, the entire contents of which are incorporated herein by reference.

BACKGROUND OF THE INVENTION

1. Field of the Invention

The present invention relates to a sheet processing apparatus and, more particularly, to a sheet processing apparatus having a sheet buffer function.

2. Description of the Related Art

In recent years, in some image forming apparatus, a sheet processing apparatus is set adjacent to a paper discharge unit of an image forming apparatus main body in order to perform finishing for sheets after image formation such as sorting of the sheets or stapling the sheets.

The sheet processing apparatus has plural means for conveying a sheet, which is conveyed from the image forming apparatus, to a paper discharge tray and discharging the sheet. The means are roughly divided into a conveying path for not performing the finishing and a conveying path for performing the finishing. When the finishing is not performed, the sheet is conveyed through the conveying path for not performing the finishing and directly discharged onto the paper discharge tray. When the finishing is performed, the sheet is conveyed to a processing tray through the conveying path for performing the finishing, which is branched from the conveying path for not performing the finishing, and stacked. When a set number of sheets are stacked, the sheets are aligned on the processing tray and subjected to the finishing.

Conventionally, there is known a sheet processing apparatus that has first and second conveying paths provided in a processing conveying path further on an upstream side than a processing unit and includes superimposing means for conveying a sheet through the first and second conveying paths, temporarily stopping the sheet, and superimposing plural sheets one on top of another, wherein the superimposing means shifts the superimposed sheets on an upper side to slightly precede the sheets on a lower side (e.g., JP-A-11-157741).

U.S. Pat. No. 7,172,187 discloses a sheet processing apparatus that puts, when finishing is necessary, plural sheets on standby on a waiting tray, causes the sheets to fall onto a processing tray provided below the waiting tray with own weight of the sheets, stacks a predetermined number of sheets, and, after aligning the sheets, staples the sheets.

BRIEF SUMMARY OF THE INVENTION

It is an object of the present invention to provide a sheet processing apparatus that has a sheet buffer function.

In an aspect of the present invention, a sheet processing apparatus includes a processing tray on which plural sheets are stacked and subjected to finishing, a sheet waiting unit configured to be provided along a conveying path to convey the sheets to the processing tray, a sheet placing member that is provided in the sheet waiting unit and on which the sheets are placed, a rotor that is provided above in a conveying direction downstream side of the sheet waiting unit and supported to be capable of rising and falling, a switching member that switches the rotor to a lifted position and a lowered position; and a driving source that pivots the rotor and conveys the sheets, wherein the sheet processing apparatus drives the switching member and the driving source and controls a sheet feeding operation by the rotor and places, in the plural sheets stacked on the sheet waiting unit, leading ends of second and subsequent sheets and aligns the leading ends with a position shifted a predetermined distance to a conveying direction upstream side from a leading end of a first sheet.

DESCRIPTION OF THE DRAWINGS

FIG. 25 is a diagram showing a relation among a parallel pin, a shaft, a spool section groove, and the like;

DETAILED DESCRIPTION OF THE INVENTION

Throughout this description, the embodiments and examples shown should be considered as exemplars, rather than limitations on the apparatus and methods.

Embodiments will be hereinafter explained with reference to the accompanying drawings.

First Embodiment

Figure 1:
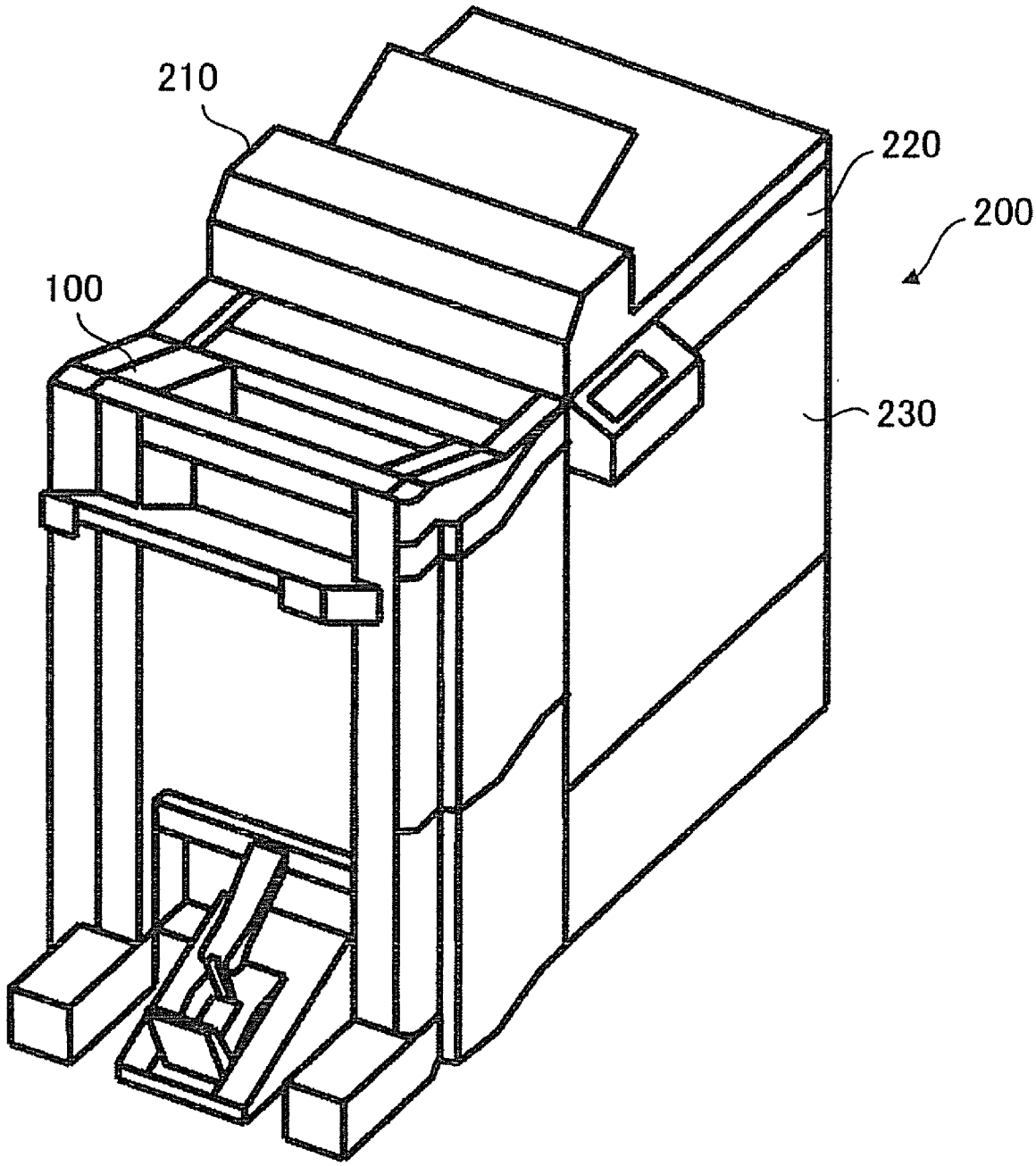
FIG. 1 is a perspective view of an image forming apparatus and a sheet processing apparatus set adjacent to the image forming apparatus.

A sheet processing apparatus 100 is set adjacent to a paper discharge unit of an image forming apparatus 200 (see FIG. 1). The image forming apparatus 200 is, for example, a digital copying machine. As shown in FIG. 1, the image forming apparatus 200 includes a scanner unit 220, which includes an auto document feeder (ADF) 210, and a printer engine unit 230 that forms an image corresponding to image data supplied from the scanner unit 220 or the outside.

The auto document feeder (ADF) 210 feeds originals to a predetermined scanning position one by one. The scanner unit 220 optically scans an image of the original and converts the image into image data. The ADF 210 and the scanner unit 220 form an image scanning apparatus.

The printer engine unit 230 forms an electrostatic latent image on an image bearing member such as a photoconductive drum, develops the electrostatic latent image with a toner, transfers a toner image formed by developing the electrostatic latent image onto a sheet serving as an image forming medium, and fixes the transferred toner image on the sheet. With such a configuration, in the image forming apparatus 200, it is possible to copy an image scanned by the scanner unit 220 on the sheet serving as the image forming medium in the printer engine unit 230. Sheets having images formed thereon by the image forming apparatus 200 are sent into the sheet processing apparatus 100 and subjected to stapling, sorting, and the like according to, for example, content of finishing selected on a control panel of the image forming apparatus 200.

Figure 2:
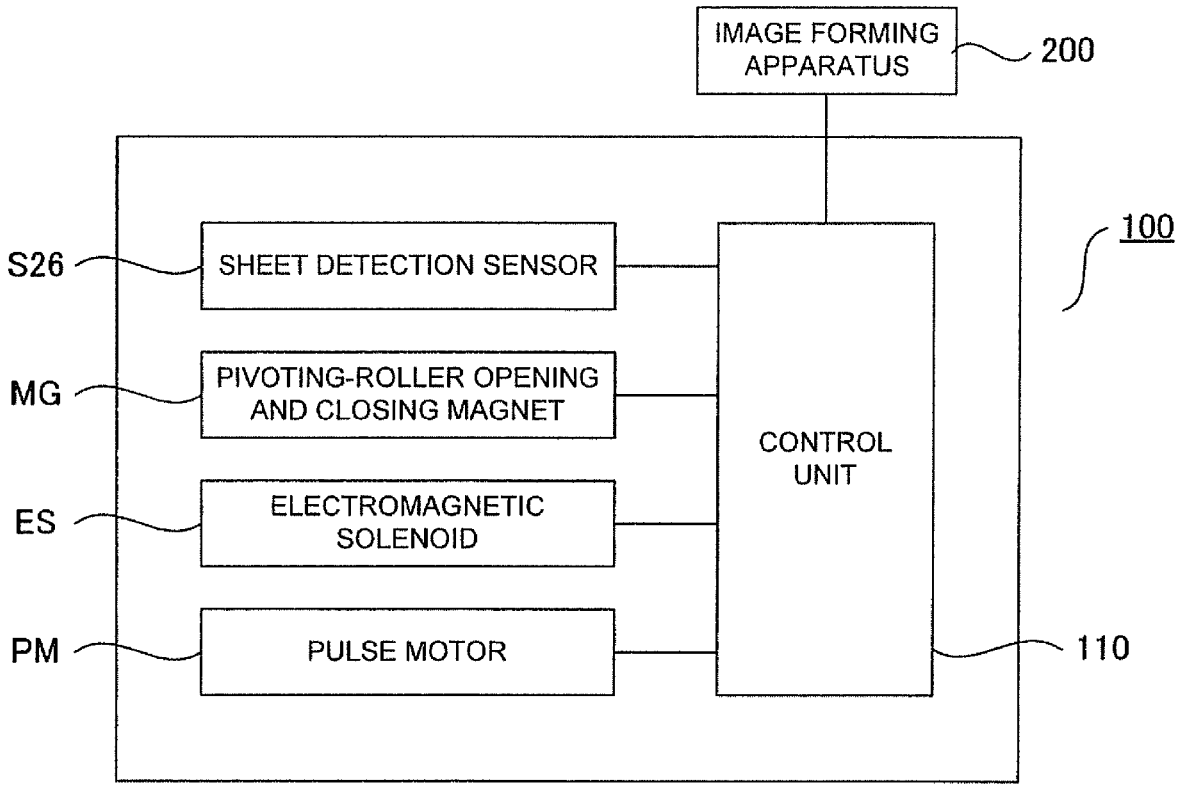
FIG. 2 is a block diagram showing an example of a configuration of a part of a control system provided in the sheet processing apparatus.

FIG. 2 is a block diagram showing an example of a configuration of a part of a control system provided in the sheet processing apparatus 100. The sheet processing apparatus 100 is connected to the image forming apparatus 200 via a control unit 110. The control unit 110 controls a sheet detection sensor S26, a pivoting-roller opening and closing magnet MG, an electromagnetic solenoid ES, a pulse motor PM, and the like described later.

Figure 3:
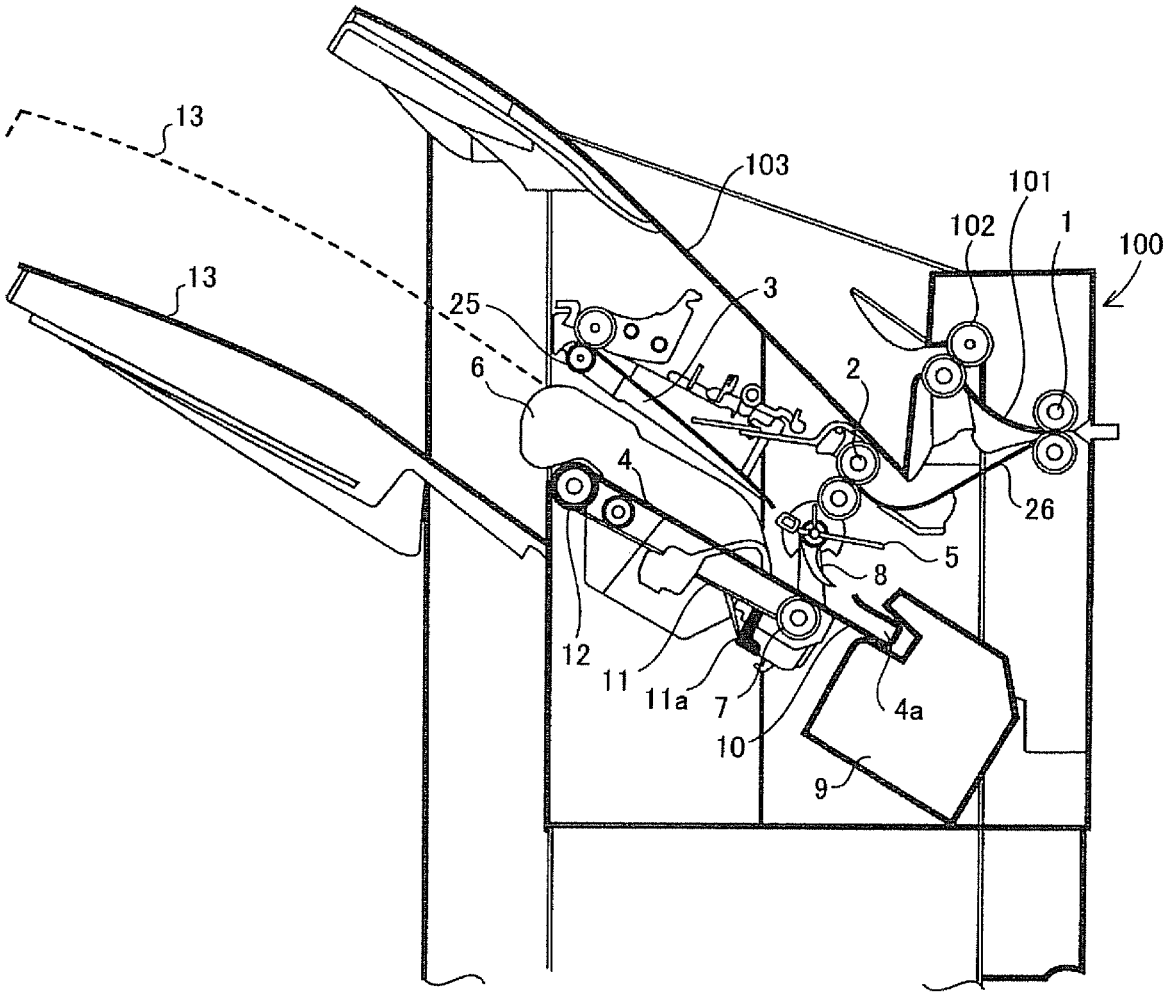
FIG. 3 is a schematic diagram of a sheet processing apparatus according to an embodiment.
Figure 4:
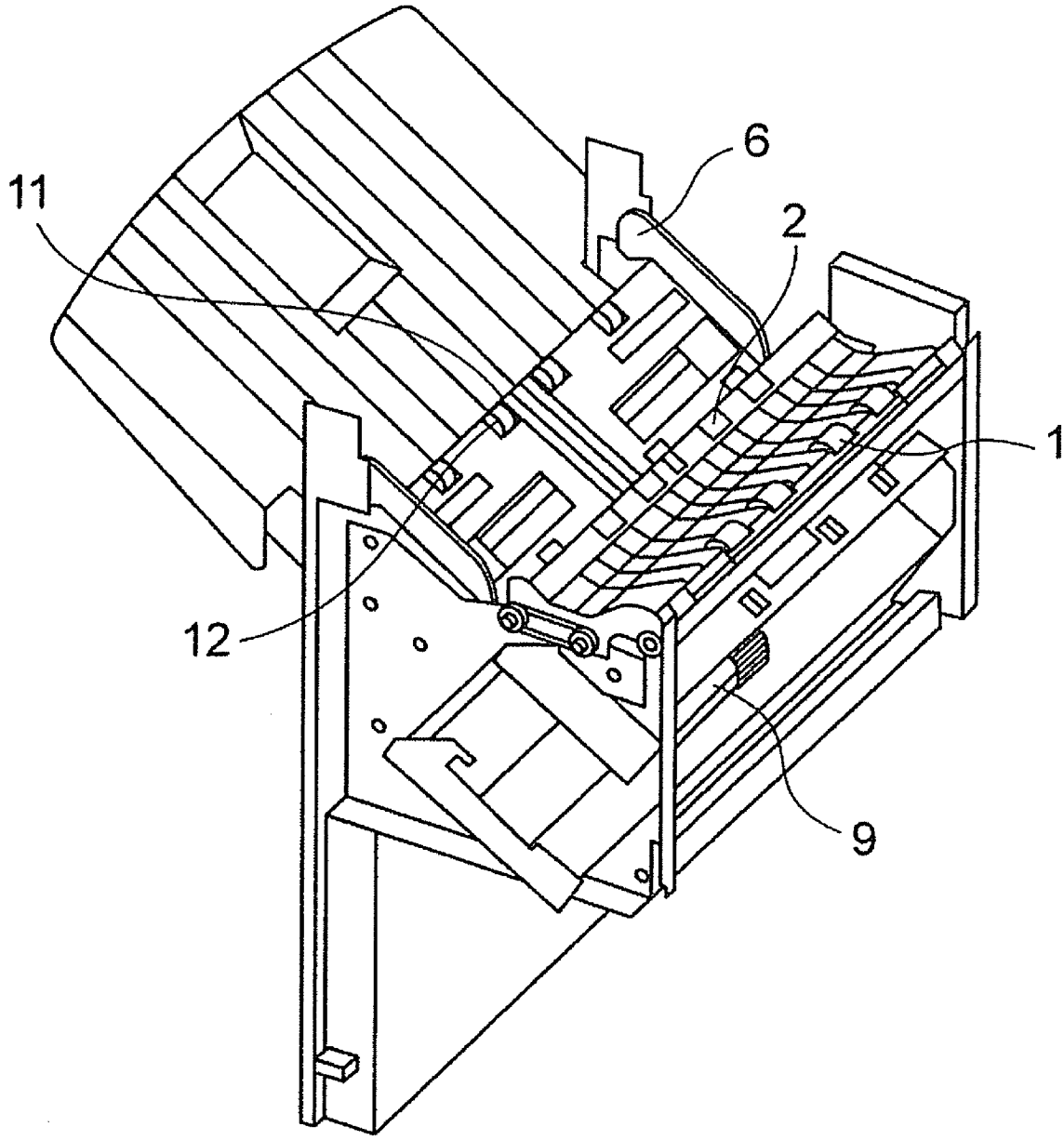
FIG. 4 is a perspective view showing the vicinity of entrance rollers of the sheet processing apparatus.
Figure 5:
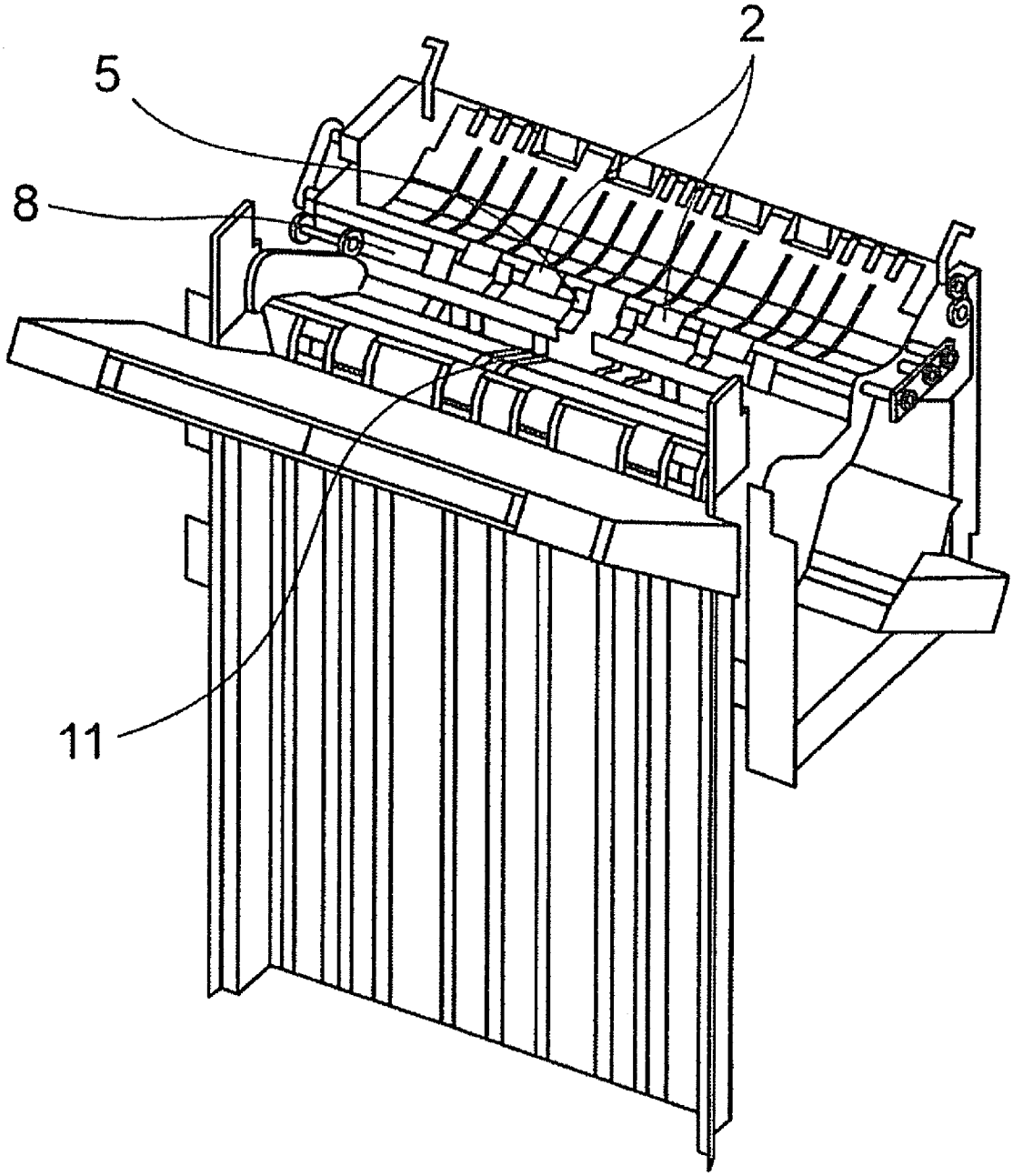
FIG. 5 is a perspective view showing the vicinity of a paddle of the sheet processing apparatus.

FIG. 3 is a schematic sectional view showing the schematic structure of the sheet processing apparatus 100. FIG. 4 is a perspective view showing the vicinity of entrance rollers of the sheet processing apparatus 100. FIG. 5 is a perspective view showing the vicinity of a paddle of the sheet processing apparatus 100.

As shown in FIG. 3, the sheet processing apparatus 100 basically includes a waiting tray 3, a processing tray 4, a stapler 9, and a stacking tray 13.

A sheet P having images formed thereon by the image forming apparatus 200 such as a copying machine are received by the pair of entrance rollers 1, fed to a pair of exit rollers 2, and sent to the waiting tray 3 from the exit rollers 2. A conveying path for guiding the sheet P to the exit rollers 2 is formed between the entrance rollers 1 and the waiting tray 3. As the conveying path, a conveying path 26 for conveying a sheet according to finishing content selected by a user and a conveying path 101 for not performing finishing are provided.

The waiting tray 3 is a tray for buffering, i.e., temporarily storing a conveyed sheet. The waiting tray 3 includes a pair of supporting members. The supporting members that support a part of sheets from both sides in a sheet width direction reciprocatingly move in a direction (the sheet width direction) orthogonal to a sheet conveying direction to be capable of opening and closing. A predetermined number of sheets placed on the waiting tray 3 are dropped onto the processing tray 4 by opening the supporting members in the sheet width direction. When the sheets are dropped, the paddle 5 is pivoted to drop the sheets.

The paddle 5 is made of an elastic body. The paddle 5 drops the sheets from the waiting tray 3 onto the processing tray 4 and aligns the sheets in the sheet conveying direction.

The processing tray 4 aligns and supports stacked sheets P while the sheets P are stapled by the stapler 9 serving as a processing mechanism that applies finishing to sheets.

For alignment in a longitudinal direction (a conveying direction), the paddle 5 of an elastic member is rotated to align an upper surface of sheets on the processing tray 4 to a sheet-trailing-end positioning section 4*a* provided in an upstream direction. Moreover, a longitudinal alignment roller 7 on the processing tray 4 is rotated in a direction opposite to a discharge direction to align a lower surface of the sheets to the sheet-trailing-end positioning section 4*a*. A sheet stop position of the sheet-trailing-end positioning section 4*a* is provided to coincide with a longitudinal wall of the ejector 10 or provided to be shifted in the discharge direction by about several millimeters.

As shown in FIGS. 3 to 5, the sheet processing apparatus 100 includes a lateral alignment plate 6 for aligning sheets in a lateral direction (orthogonal to the sheet conveying direction) on the processing tray 4, the longitudinal alignment roller 7, a sheet guide 8, a stapler 9, an ejector 10, a bundle pawl belt 11, a discharge roller 12 that normally rotates to convey and discharge sheets and is capable of pivoting in association with the longitudinal alignment roller 7, and a stacking tray 13. The stacking tray 13 is capable of rising and falling in an up to down direction. Sheets discharged after finishing such as sorting are stacked on the stacking tray 13.

The waiting tray 3 is capable of dropping and feeding the sheets P onto the processing tray 4 and, on the other hand, capable of conveying the sheets P in the stacking tray 13 direction.

The waiting tray 3 is arranged to be inclined as shown in FIG. 3 in order to support the sheets P in a state in which a leading end of the sheets P is higher than a trailing end thereof. The stacking tray 13 is arranged to be inclined as shown in FIG. 3 in order to support the sheets P in a state in which the leading end of the sheets P is higher than the trailing end thereof.

The sheet processing apparatus 100 includes plural mechanism such as a conveying mechanism to convey sheets from the sheet processing apparatus 100 to the stacking tray 13 and a discharging device to discharge the sheets. The plural mechanisms are roughly divided into two, i.e., a path to perform the finishing and a path not to perform the finishing.

First, the path to subject sheets to the finishing is explained. The finishing includes, for example, stapling to bind bundled sheets with staples and sorting to align the sheets.

Sheets conveyed for the finishing from the image forming apparatus 200 are conveyed to the waiting tray 3 in the sheet processing apparatus 100 first. For such conveyance, an entrance roller motor (not shown) is normally rotated to transmit a driving force to the entrance rollers 1 and the exit rollers 2. The waiting tray 3 temporarily stocks the sheets conveyed form the exit rollers 2 and, then, drops the sheets to feed onto the processing tray 4.

When sheets are conveyed to the sheet processing apparatus 100 anew for the next port-processing, during finishing work in the processing tray 4 or during discharge conveyance of the sheets after the finishing, the sheets are put on standby on the waiting tray 3 in which the sheets can be temporarily stored.

For improvement of performance of a series of processing from image formation to finishing, it is preferable that plural sheets can be put on standby (buffered) on the waiting tray 3 in order to secure processing time. However, when sheets each having mass are simply stacked and put on standby, it is difficult to transmit power for alignment in the conveying direction to sheets located in the middle of plural stacked sheets. Therefore, when the sheets put on standby is sent into the processing tray 4, alignment of the sheets may be disordered. Stability of alignability is realized more when the sheets are stacked on the processing tray 4, on which the sheets can be stacked over the entire sheet width, than when the sheets are put on standby on the waiting tray 3 for a long time.

In the sheet processing apparatus 100 according to this embodiment, when two or three or more plural sheets P put on standby are dropped onto the processing tray 4, stacking on the waiting tray 3, with which excellent longitudinal alignability on the processing tray 4 can be obtained, is realized.

A method of stacking three sheets on the waiting tray 3 is explained below.

Figure 6:
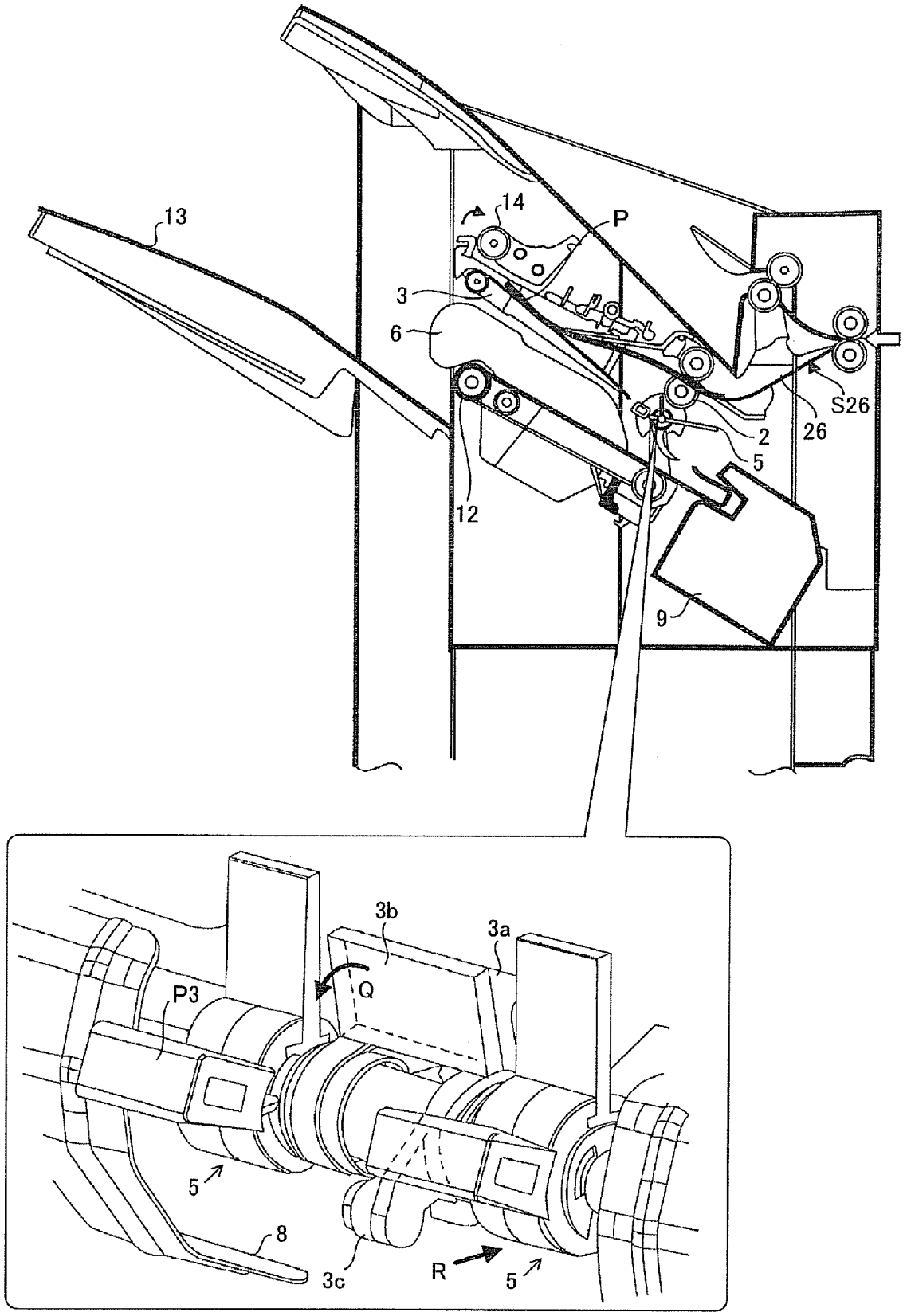
FIG. 6 is a diagram for explaining a sheet buffering operation.
Figure 7:
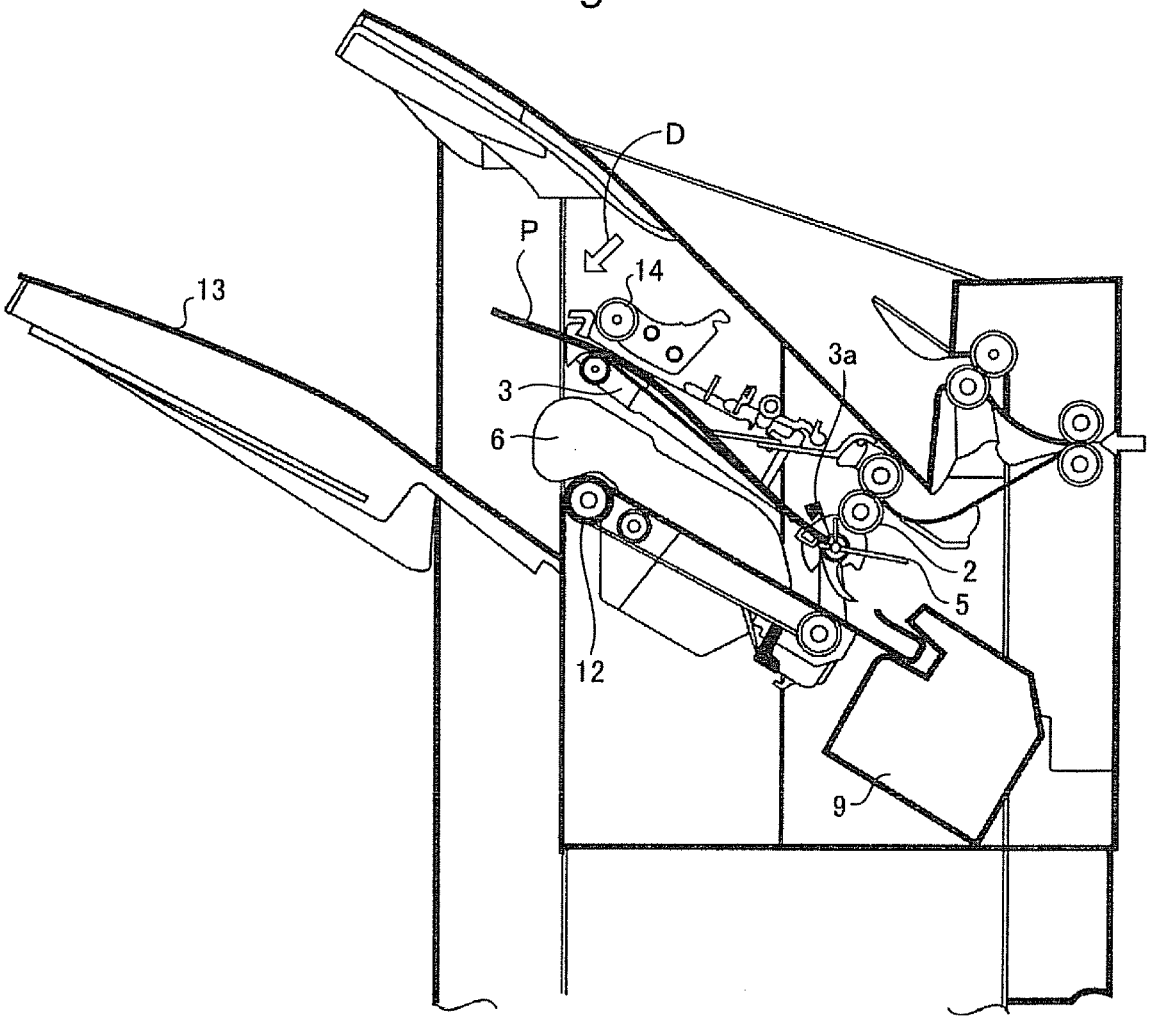
FIG. 7 is a diagram for explaining the sheet buffering operation.

Stacking of a first sheet on the waiting tray 3 is explained below with reference to FIGS. 6 and 7. FIG. 6 is a diagram for explaining a state of conveyance for stacking the first sheet on the waiting tray 3. FIG. 7 is a diagram for explaining the state in which the first sheet is stacked on the waiting tray 3.

First, when a leading end of the first sheet is conveyed to the vicinity of pivoting rollers 14, the pivoting-roller opening and closing magnet MG is actuated to lift the pivoting rollers 14 by 4 to 5 mm to a lifted position. A pivoting motor (not shown) is normally rotated in this state to rotate the pivoting rollers 14 in the conveying direction. This is for the purpose of preventing the conveyed leading end of the first sheet from colliding with the pivoting rollers 14 (see FIG. 6).

The waiting tray 3 is disposed to be inclined such that an upstream side in the conveying direction is low and a downstream side is high. Therefore, the first sheet discharged from the exit rollers 2 is stacked on the waiting tray 3 and a P3 upper surface of the paddle 5 because of own weight thereof. After the stacking, the electromagnetic solenoid ES and the like are actuated to pivot a chuck lever 3*a* in an arrow Q direction to hold a trailing end of the sheet. A link 3*c* coupled to the electromagnetic solenoid ES is assembled to one end of the chuck lever 3*a*. A gripping member 3*b* (e.g., a urethane rubber sheet) that is made of a surface having a high coefficient of friction and has elasticity is bonded to the other end side. According to the actuation of the electromagnetic solenoid ES, the link 3*c* is pulled in an arrow R direction and the gripping member 3*b* pivots to a position for pressing an upper surface of the sheet (see FIG. 6).

After the first sheet is completely stacked on the waiting tray 3 (see FIG. 7), the pivoting rollers 14 are lowered in an arrow D direction from the lifted position to press the sheet on the waiting tray 3. Consequently, it is possible to press both the leading end and the trailing end of the sheet. This is for the purpose of stably holding the first sheet on the waiting tray 3.

Figure 8:
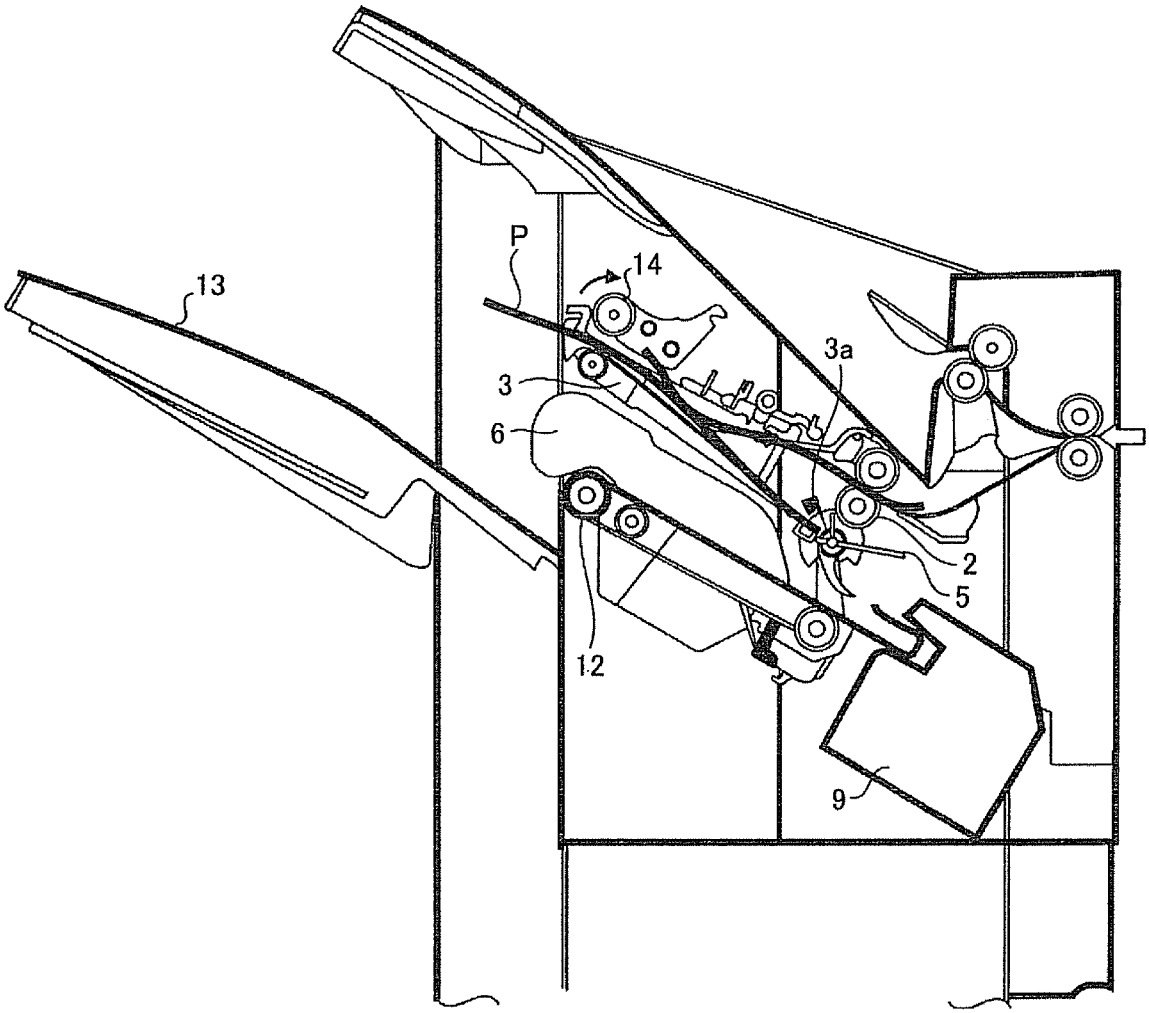
FIG. 8 is a diagram for explaining the sheet buffering operation.
Figure 9:
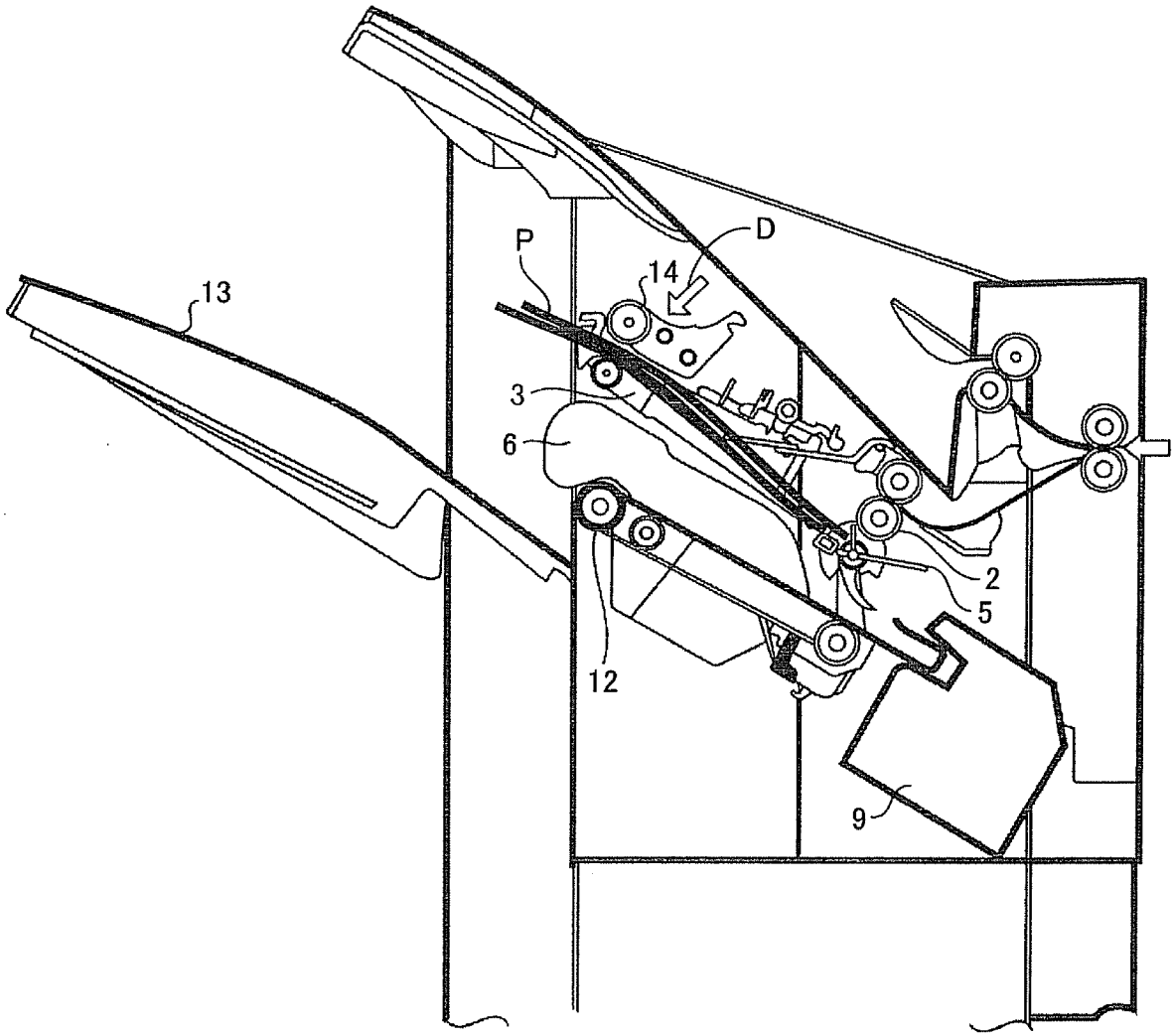
FIG. 9 is a diagram for explaining the sheet buffering operation.
Figure 10:
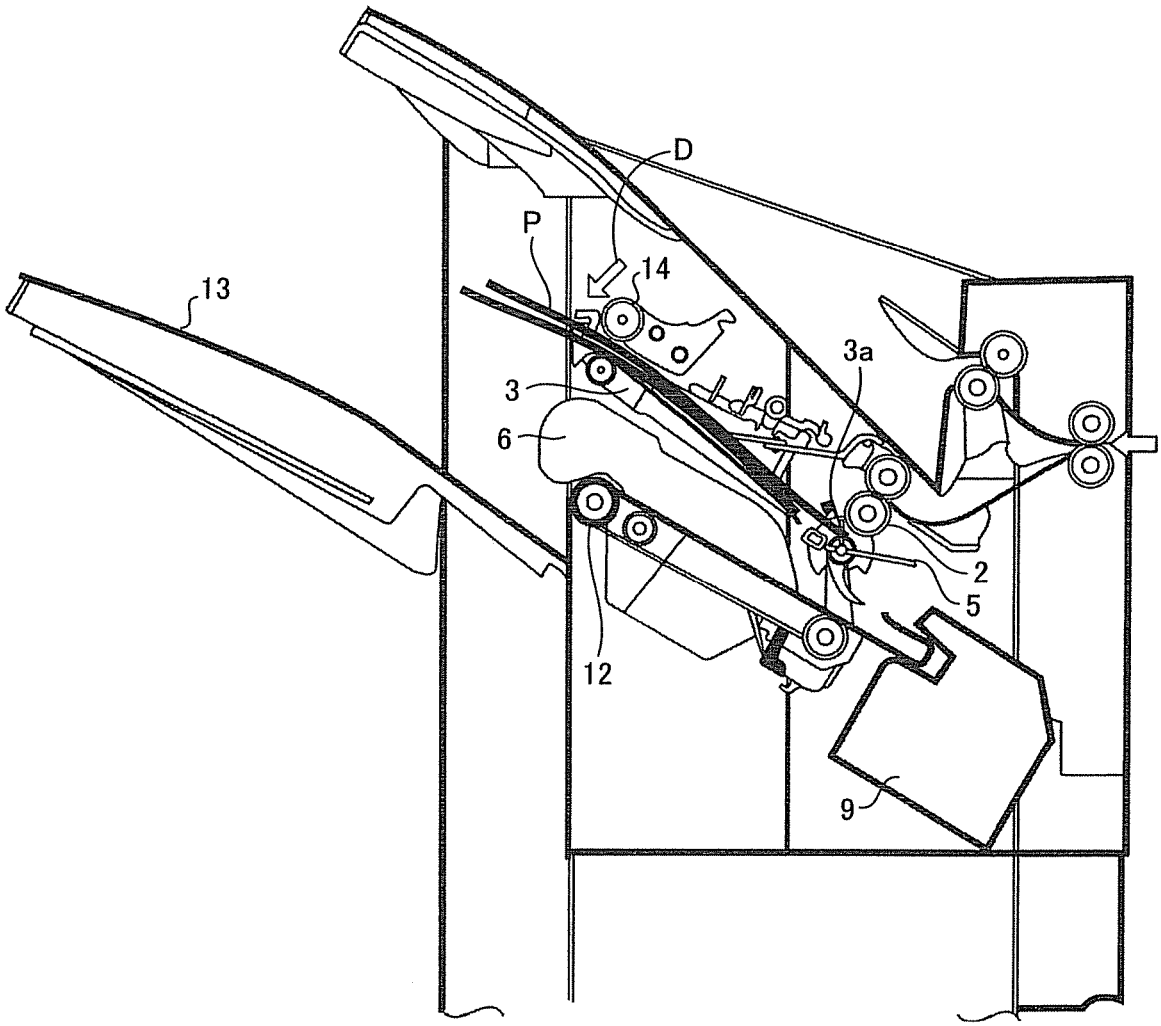
FIG. 10 is a diagram for explaining the sheet buffering operation.

Stacking of a second sheet on the waiting tray 3 is explained. FIG. 8 is a diagram for explaining a state of conveyance of the second sheet to the waiting tray 3. FIG. 9 is a diagram for explaining a state in which the first sheet and the second sheet are stacked on the waiting tray 3 with leading ends thereof shifted from each other. FIG. 10 is a diagram for explaining a state in which the second sheet is stacked on the waiting tray 3.

When the leading end of the second sheet is conveyed to the vicinity of the pivoting rollers 14, the pivoting-roller opening and closing magnet MG is actuated to lift the pivoting rollers 14, which holds the first sheet on the waiting tray 3, to the lifted position. In this state, the pivoting motor is normally rotated to rotate the pivoting rollers 14 in the conveying direction (see FIG. 8). This is for the purpose of reducing, even if the second sheet hits the pivoting rollers 14, a load of impact and preventing paper jam.

In this case, the trailing end of the first sheet stacked on the waiting tray 3 earlier is pinched by the chuck lever 3*a* and the pivoting rollers 14 are rotating in the conveying direction. However, since the pivoting rollers 14 are in the lifted position, the first sheet is not conveyed.

Thereafter, before the drop and stacking of the second sheet on the waiting tray 3 is completed, the trailing end of the first sheet pinched by the chuck lever 3*a* and the P3 upper surface of the paddle 5 is released. At timing when the leading end of the second sheet reaches a position shifted by a predetermined amount to the upstream side from the leading end of the first sheet, the pivoting rollers 14 in the lifted position is dropped in the arrow D direction after a predetermined time elapses while being kept on rotating in the conveying direction.

According to this operation, the second sheet is conveyed while a state in which the first sheet is shifted further to the leading end side than the second sheet (conveyed earlier in the conveying direction) is kept. An amount of the shift of the first sheet and the second sheet is set to 5 to 20 mm. For example, when taking fluctuation during the drop and slip-down into account, 10 mm is suitable as the amount of the shift. A pulse of the pulse motor PM that conveys the second sheet is counted and, at timing when a difference between the leading ends of the two sheets reaches 10 mm, the pivoting rollers 14 in rotation are lowered and nipped. Then, until discharge of the trailing end of the second sheet from the exit rollers 2 is completed, the first sheet and the second sheet are simultaneously conveyed in a downstream direction by the pivoting rollers 14. After the discharge is completed, the rotation of the pivoting rollers 14 is stopped (see FIG. 9). The second sheet falls onto the waiting tray 3 and the P3 upper surface of the paddle 5 because of own weight thereof while keeping the positional shift of the leading ends of the sheets.

Thereafter, after the second sheet is stacked on the P3 upper surface of the paddle 5, like the first sheet, the trailing end of the second sheet is held by the chuck lever 3*a* (see FIG. 10).

Consequently, the shifted leading ends and trailing ends of the sheets are held to complete the stacking of the two sheets on the waiting tray 3.

Figure 11:
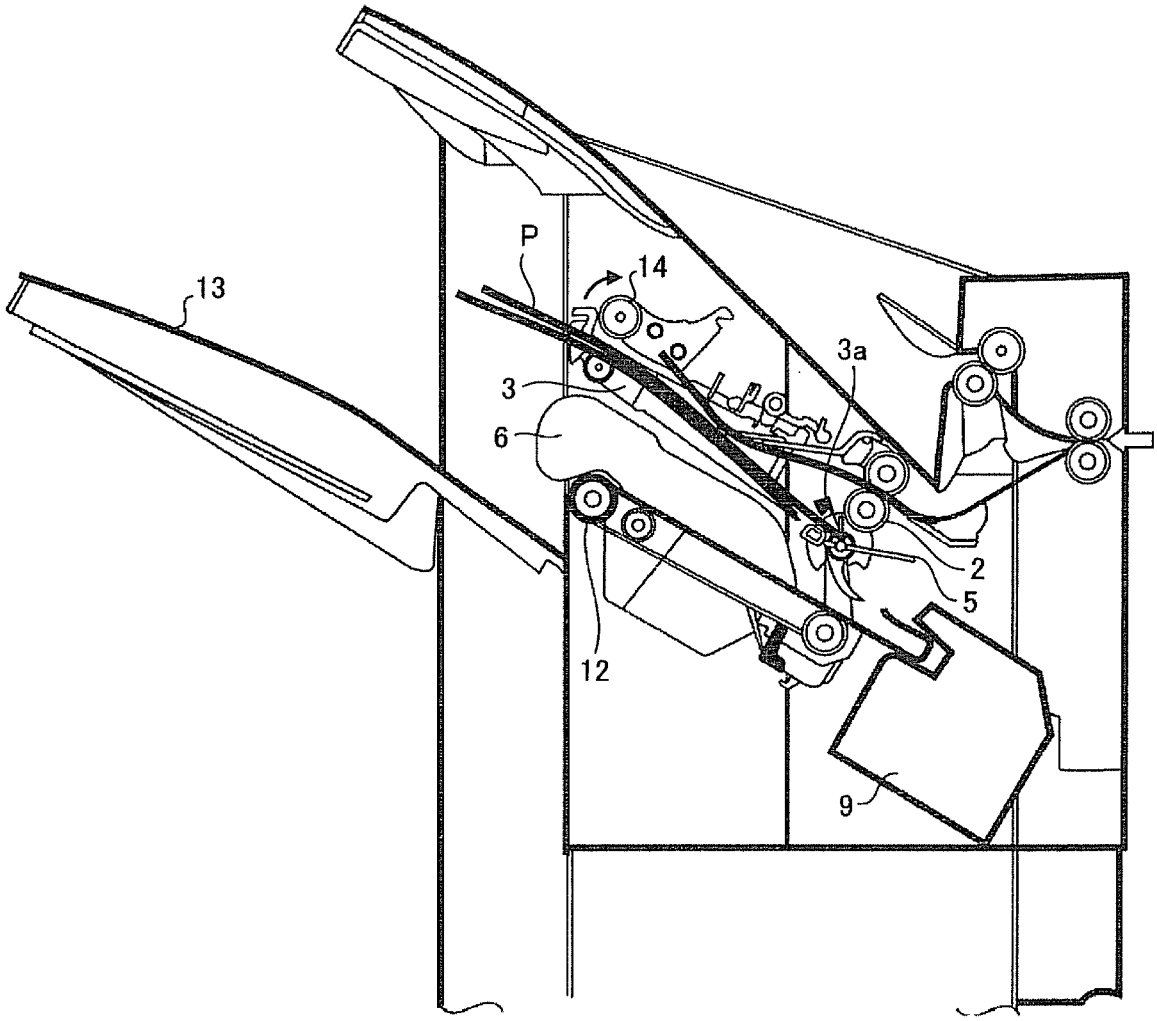
FIG. 11 is a diagram for explaining the sheet buffering operation.
Figure 12:
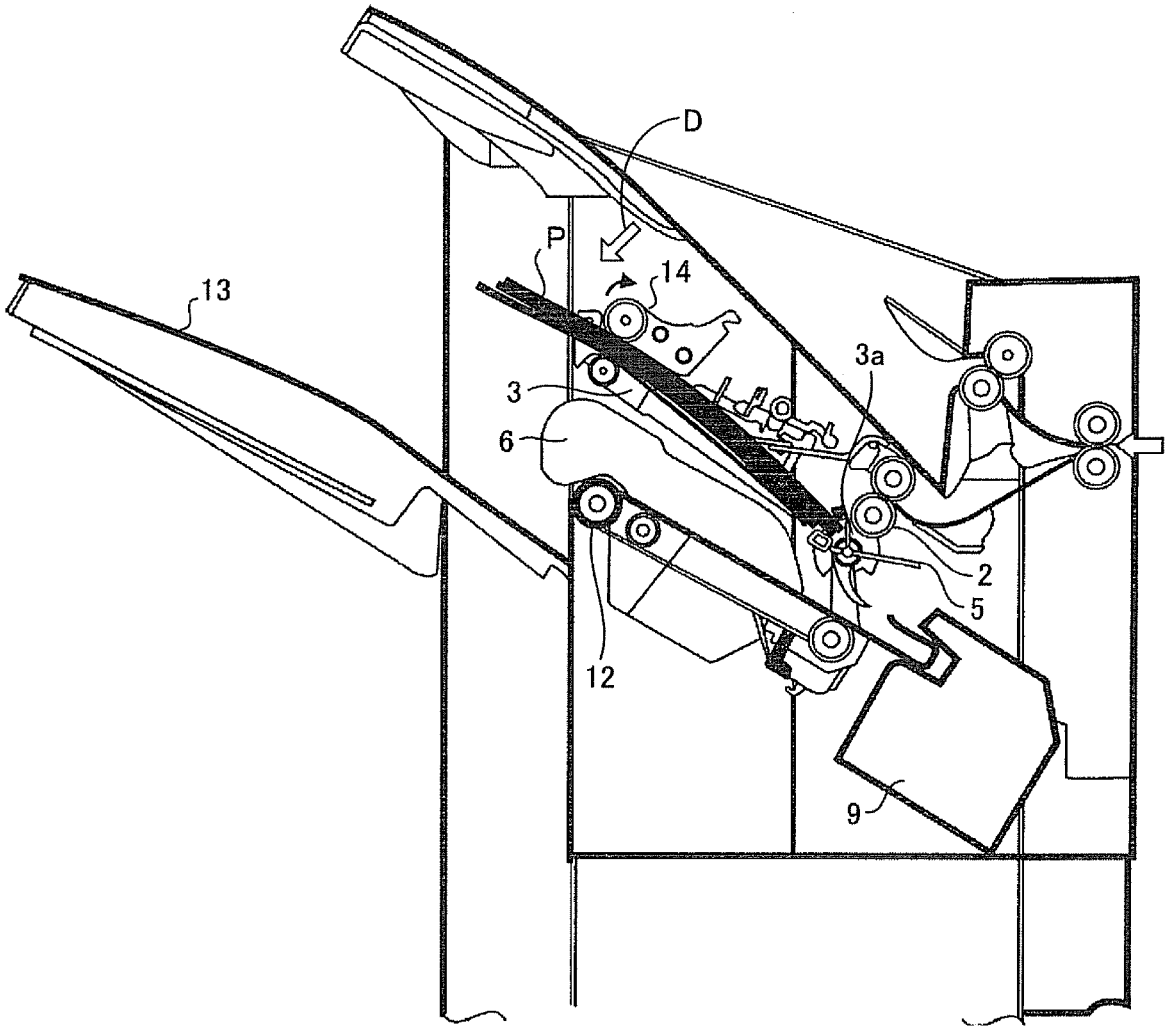
FIG. 12 is a diagram for explaining the sheet buffering operation.

Stacking of a third sheet on the waiting tray 3 is explained. FIG. 11 is a diagram for explaining a state of conveyance for stacking the third sheet on the waiting tray 3. FIG. 12 is a diagram for explaining a state in which the second sheet and the third sheet are conveyed and stacked while being shifted a predetermined amount from the leading end of the first sheet.

Figure 13:
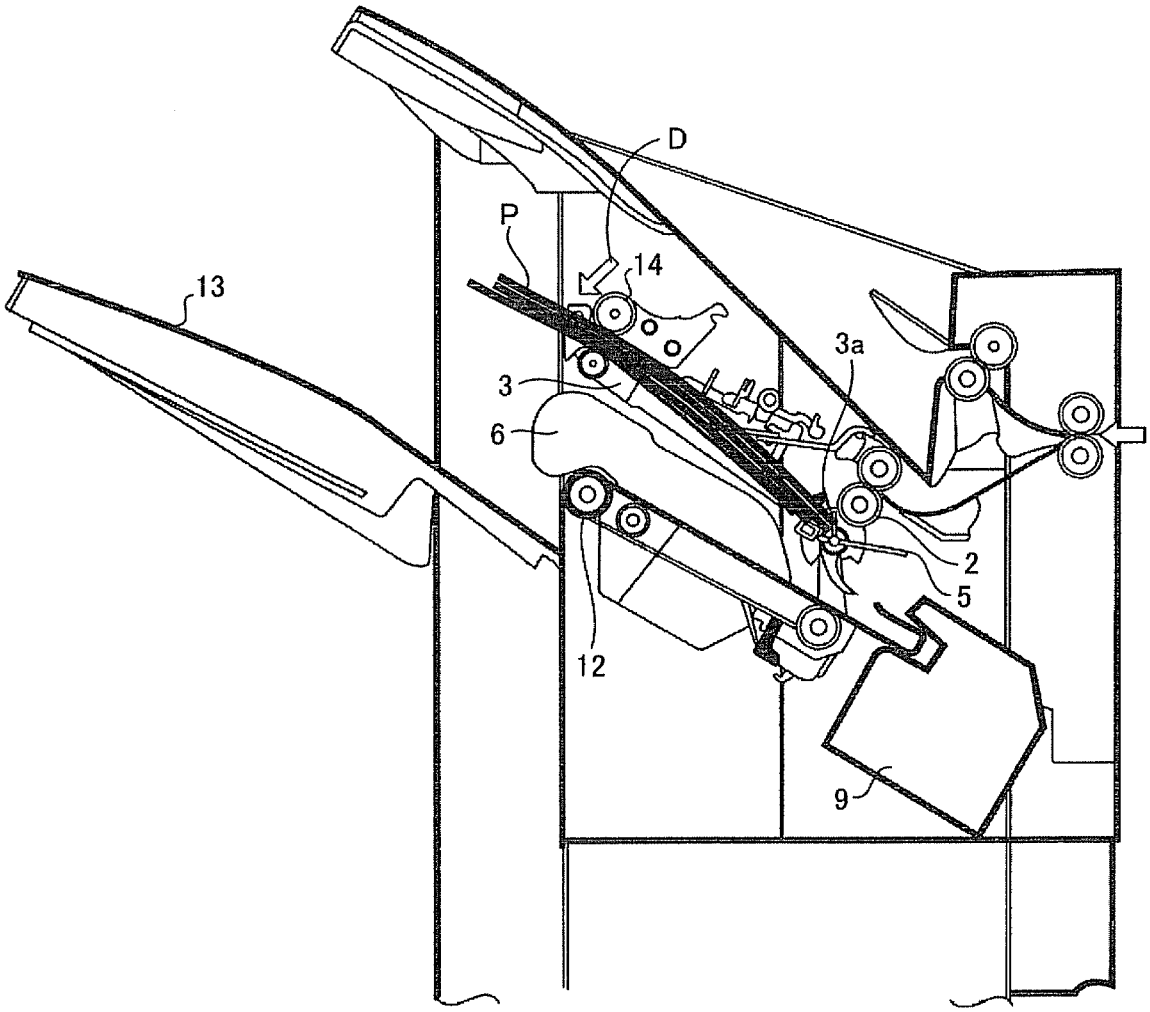
FIG. 13 is a diagram for explaining the sheet buffering operation.

FIG. 13 is a diagram for explaining a state in which the third sheet is stacked on the waiting tray 3.

When a leading end of the third sheet is conveyed to the vicinity of the pivoting rollers 14, the pivoting-roller opening and closing magnet MG is actuated to lift the pivoting rollers 14, which press the first and second sheets on the waiting tray 3, to the lifted position. In this state, the pivoting motor is normally rotated to rotate the pivoting rollers 14 in the conveying direction (see FIG. 11).

In this case, the trailing end of the first and second sheets stacked on the waiting tray 3 earlier is pinched by the chuck lever 3*a* and the pivoting rollers 14 are rotating in the conveying direction but are in the lifted position. Therefore, the first and second sheets are not conveyed.

Before the trailing end of the third sheet falls onto the waiting tray 3 and the stacking is completed, i.e., at a point when the leading end of the second sheet and the leading end of the third sheet are found to nearly overlap by counting a pulse of the pulse motor PM that drives the exit rollers 2, the pulse motor PM is stopped. The chuck lever 3*a* is released and the pivoting rollers 14 in the lifted position are dropped in the arrow D direction while being kept rotating in the conveying direction (see FIG. 12). At this point, since the pivoting rollers 14 are rotating in the conveying direction, the sheet is sent downstream. However, after several pulses elapse, the rotation of the pivoting rollers 14 is stopped.

According to this operation, the third sheet overlaps the second sheet with leading end positions thereof aligned while the shifted positional relation of the first and second sheets do not changed.

As a stacking shift amount of the three sheets on the waiting tray 3, the first sheet is in a position most advanced to the downstream side in the conveying direction and the second and third sheets are in a position further shifted upstream by about 10 mm from that position. In this positional relation, the respective sheets are pressed on the waiting tray 3 by the pivoting rollers 14 (see FIG. 13). In this case, when there is no sheet to be conveyed next or when it is unnecessary to put a sheet on standby, it is unnecessary to pinch the trailing end of the second and third sheets with the chuck lever 3*a*.

As described above in detail, when the number of sheets to be stapled is three at the maximum, after being buffered on the waiting tray 3, the pair of supporting members forming the waiting tray 3 are opened and moved in the sheet width direction and the sheets are dropped and fed onto the processing tray 4. Therefore, since the sheets dropped and fed onto the processing tray 4 are landed on the processing tray 4 from the trailing end of the sheets, longitudinal alignability on the processing tray 4 is satisfactory.

When there is a following fourth sheet that should be put on standby, the fourth sheet only has to be conveyed and stacked in a process same as that for the third sheet and buffered on the waiting tray 3 while being pressed by the pivoting rollers 14 and the chuck lever 3*a*.

Figure 14:
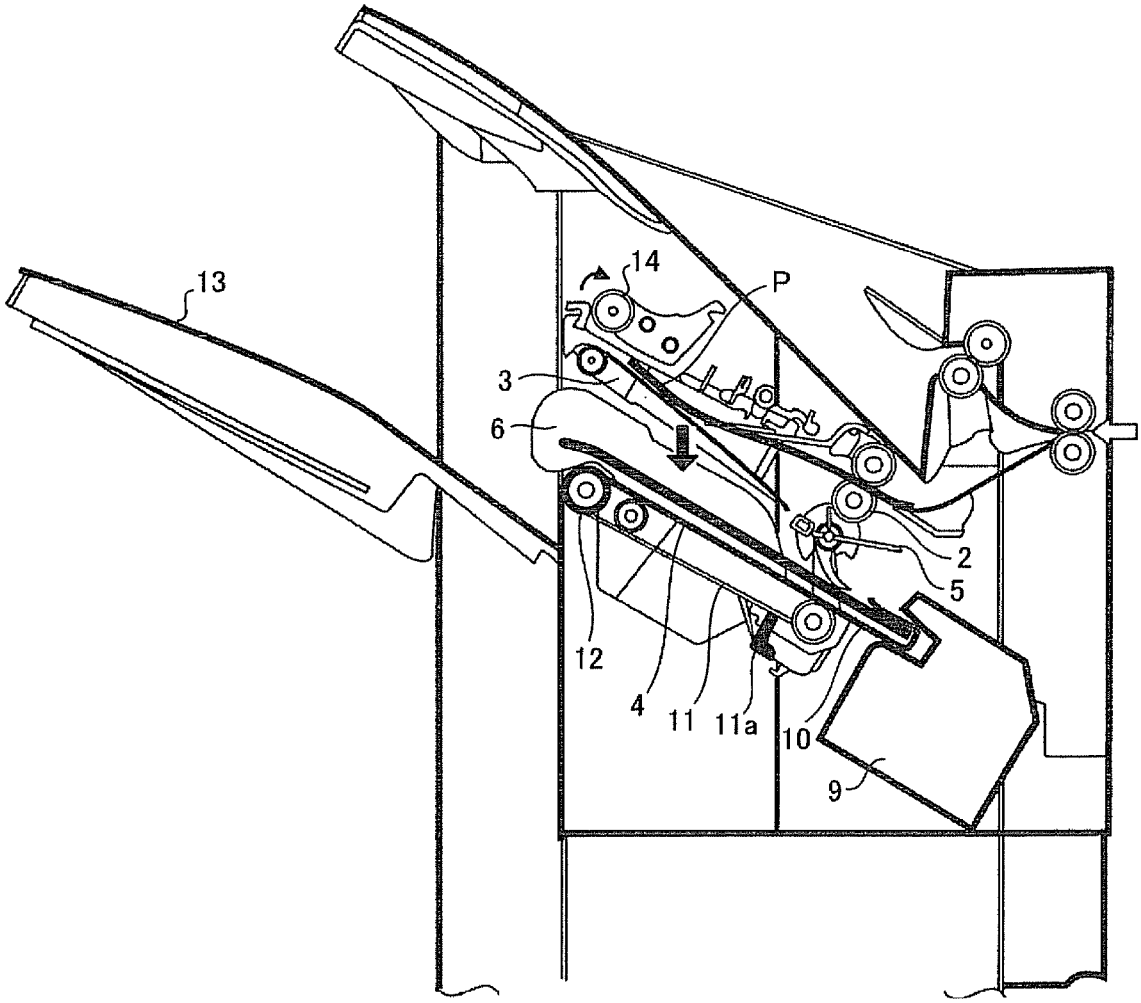
FIG. 14 is a diagram for explaining the sheet buffering operation.

When the number of sheets buffered on the waiting tray 3 is three and the number of sheets subjected to finishing is four or more, first, the three sheets buffered on the waiting tray 3 are dropped onto the processing tray 4. Subsequently, after the following sheets are temporarily discharged and stacked on the waiting tray 3, the sheets are dropped onto the processing tray 4 one by one (see FIG. 14). Such processing may be applied to the fifth or the sixth and subsequent sheets in the same manner. After being temporarily discharged and stacked on the waiting tray 3, the sheets are always dropped and fed onto the processing tray 4 from a trailing end side of the sheets. Consequently, longitudinal alignability of the falling sheets on the processing tray 4 is satisfactory.

It goes without saying that it is also possible to perform control for maintaining the waiting tray 3 in the opened state and directly dropping and feeding the fourth and subsequent sheets onto the processing tray 4 without temporarily discharging and stacking the sheets on the waiting tray 3.

When the number of the sheets P stacked on the processing tray 4 reaches a predetermined number, the sheets P are aligned in a longitudinal direction and a lateral direction and, then, a sheet bundle T stapled by the stapler 9 is formed. Thereafter, the sheet bundle T is conveyed in a direction of the stacking tray 13 by the driving of the longitudinal alignment roller 7, the ejector 10, and the bundle pawl belt 11, and a trailing end of the sheet bundle T is caught by a bundle pawl 11*a* provided in the bundle pawl belt 11 and discharged onto the stacking tray 13. In this way, the stapling of the sheets P is completed.

When the number of sheets to be put on standby is four or more and the number of sheets to be subjected to finishing is five or more, the fourth sheet only has to be put on standby and conveyed in the same manner as the third sheet described above.

According to this embodiment, in buffering the third sheet, the second and third sheets are stacked on the waiting tray 3 to be shifted further on the trailing end side, i.e., the upstream side in the conveying direction than the first sheet. Therefore, during the longitudinal alignment processing in the processing tray 4 after that, alignment of the second sheet held between the first and third sheets can be surely performed. In other words, when the sheets stacked on the waiting tray 3 are dropped and fed, an uppermost (the third) sheet is aligned to the sheet-trailing-end positioning section 4*a* according to actuation of the paddle 5 described later. On the other hand, a lowermost (the first) sheet stacked on the processing tray 4 is conveyed in a direction opposite to the conveying direction according to reverse rotation of the longitudinal alignment roller 7 and the discharge roller 12 and aligned to the sheet-trailing-end positioning section 4*a*. As described above, when a lowermost sheet stacked to be shifted about 10 mm in the sheet conveying direction is aligned and conveyed, a sheet stacked in the middle (the second sheet) is conveyed following the first sheet because of, in particular, frictional resistance of the second sheet and the first sheet even if the stacking on the waiting tray 3 shifts in the upstream direction. Therefore, alignability is improved.

In the embodiment described above, the method of stacking the three buffered sheets is described in detail. However, sheet processing speed (discharge speed) of the image forming apparatus 200 and processing speed of the sheet processing apparatus 100 change according to various conditions and are not fixed. In other words, interval time of sheets supplied to the sheet processing apparatus 200 is different according to a difference in a printing mode such as simplex and duplex printing and a high-definition mode and a difference in a material and a size of a printing medium. Moreover, it is difficult to always fix processing time of the sheet processing apparatus 100 because of a difference in stapling positions such as a paper corner and two places at ends, a material and thickness of a medium, and the number of processed sheets.

Therefore, for improvement of processing performance and alignability of the sheet processing apparatus 100, it is effective to increase or decrease the number of sheets to be buffered.

For example, after the first and second sheets are supplied at low speed from the image forming apparatus 200, when the third sheet is not supplied even when a predetermined time elapses after the second sheet passes, if the processing on the processing tray 4 is completed, the two sheets being buffered on the waiting tray 3 only have to be dropped onto the processing tray 4 and the third sheet alone only has to be conveyed to the processing tray 4 through the waiting tray 3. Consequently, alignability on the processing tray 4 is improved and performance does not fall. On the other hand, even when the first and second sheets are supplied at low speed, if sheet interval time is within a predetermined time, processing time is secured even if the third sheet is buffered on the waiting tray 3. Therefore, performance does not fall.

Therefore, the sheet processing apparatus 100 according to this embodiment includes a control unit that can change the number of buffered sheets on the waiting tray 3 according to standard printing speed of the image forming apparatus 200 and processing speed of the sheet processing apparatus 100. In other words, when the sheets P to be subjected to finishing is conveyed via the entrance rollers 1, which pivots in synchronization with sheet supplying speed from the image forming apparatus 200, and sheet interval time detected by a sheet detection sensor S26 provided in the conveying path 26 exceeds predetermined time, the number of buffered sheets put on standby on the waiting tray 3 is reduced to a number not exceeding three (e.g., two) on the basis of processing speed in the finishing on the processing tray 4 to secure processing time. When sheets are supplied from the image forming apparatus 200 within the predetermined time and the finishing on the processing tray 4 is not completed, the number of buffered sheets is controlled to be increased to three or more. As the sheet interval time of plural sheets P passing through the conveying path 26, elapsed time from detection of passage of a trailing end of a preceding sheet P (e.g., a first sheet) until detection of a leading end of the next sheet P only has to be measured by the sheet detection sensor S26. By controlling the number of buffered sheets on the waiting tray 3 on the basis of the sheet interval time of the sheets supplied from the image forming apparatus 200 to the sheet processing apparatus 100 in this way, it is possible to realize stabilization of sheet alignability on the processing tray 4 without causing deterioration in performance.

As a form (a modification) of this embodiment, a predetermined threshold of the sheet interval time of sheets passing through the conveying path 26 is set on the basis of sheet interval time of discharge and conveyance at standard printing speed (e.g., A4 size monochrome printing speed 65 sheets/minute) of the image forming apparatus 200 and average processing speed of the respective kinds of finishing (sorting and stapling). However, the number of buffered sheets and a threshold of the sheet interval time only have to be appropriately set taking into account total performance.

When the finishing is not performed, for example, the stacking tray 13 slides to a position indicated by a broken line in FIG. 3 and it is possible to stack the sheets P discharged from the waiting tray 3 with high alignability. For example, when an image forming apparatus connected to a network is used or when a large quantity of sheets are printed, the sheets P conveyed from the entrance rollers 1 to the exit rollers 2 through the conveying path 26 are conveyed to the waiting tray 3 by the exit rollers 2. Subsequently, the sheets P are dropped onto the waiting tray 3, conveyed by the pivoting rollers 14, and discharged to the stacking tray 13.

Moreover, when the finishing is not performed and an operator of the image forming apparatus 200 takes a copy facing the image forming apparatus 200, as a route through which the operator can easily take out sheets, as shown in FIG. 3, the sheets P conveyed from the image forming apparatus 200 (in an arrow direction) are conveyed through the branched conveying path 101, discharged from a roller pair 102, and stacked on a sheet placing unit 103.

Second Embodiment

Figure 15:
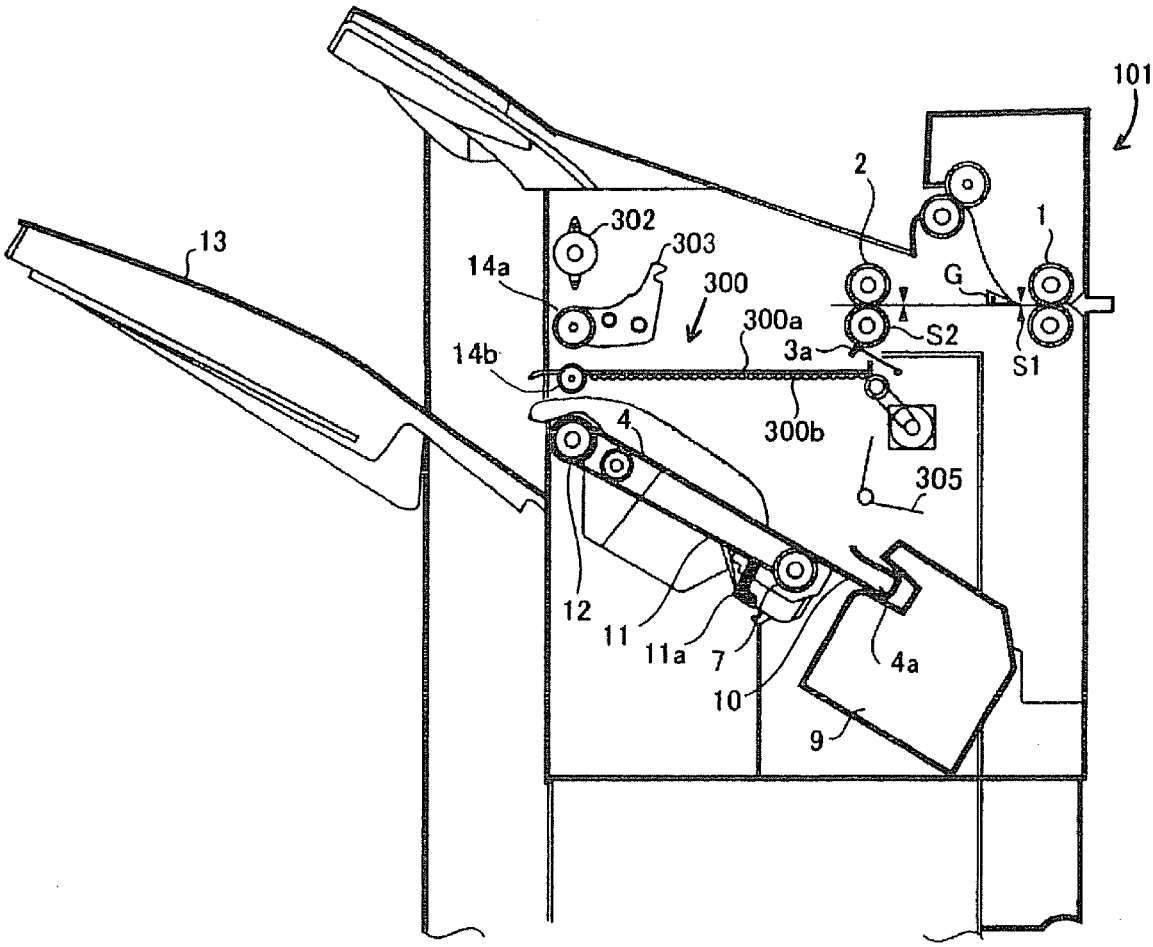
FIG. 15 is a schematic diagram of a sheet processing apparatus according to another embodiment.

A configuration for buffering sheets until the sheets are dropped to the processing tray 4 is not limited to the configuration of the waiting tray 3 explained above. In the first embodiment, the waiting tray 3 is disposed to be inclined in the sheet processing apparatus 100 and a leading end of sheets stacked on the waiting tray 3 is in a position higher than a trailing end thereof. On the other hand, a sheet processing apparatus 101 according to a second embodiment is configured as shown in FIG. 15. A basic configuration of the sheet processing apparatus 101 is the same as that of the sheet processing apparatus 100 according to the first embodiment. Therefore, characteristic differences are mainly explained.

As shown in FIG. 15, a sheet having an image formed thereon by the image forming apparatus 200 is received by the pair of inlet rollers 1 and fed to the pair of outlet rollers 2. A conveying path is formed between the inlet rollers 1 and the outlet rollers 2. Sheet detection sensors S1 and S2 are arranged to be opposed to the conveying path in front and rear portions of the conveying path. A leading end and a trailing end of a sheet in the conveying path are sensed by the sheet detection sensors S1 and S2. A gate member G for switching a sheet conveying route is provided near the sheet detection sensor S1 on the inlet rollers 1 side. A sheet placing unit 300 is disposed as a sheet waiting unit substantially in parallel to the conveying path slightly below the pair of outlet rollers 2. The sheet placing unit 300 includes a sheet placing stand 300*a*, a rack gear 306, and a sheet placing stand moving motor 307.

The sheet placing stand 300*a* is horizontally arranged in the sheet processing apparatus 101. Plural sheets can be stacked on the sheet placing stand 300*a*. The sheet placing stand 300*a* is formed by arranging a pair of members having, for example, a substantially L-shaped section and opposed to each other or is formed in a united tray shape. Sheets discharged from the outlet rollers 2 are stacked and supported on the sheet placing stand 300*a*. A sheet placing stand rack 300*b* formed in a lower portion of the sheet placing stand 300*a* (on a rear surface side of a sheet stacking surface) or formed in a side portion of the sheet placing stand 300*a* meshes with the rack gear (a pinion) 306. The sheet placing stand 300*a* is movable in a direction for releasing the support of the sheets stacked on the sheet placing stand 300*a* (a horizontal direction) according to a rotating motion of the rack gear 306. The rack gear 306 is driven by the sheet placing stand moving motor 307.

A rotor 14*a* driven to rotate by a driving motor 302 and supported to be pivotable with respect to a shaft 303 is provided above in a sheet conveying direction downstream side of the sheet placing stand 300*a*. This rotor (hereinafter referred to as pivoting roller 14*a*) is disposed to be capable of rising and falling according to the actuation of a driving source described later. The pivoting roller 14*a* and a pinch roller 14*b*, which forms a pair with the pivoting roller 14*a*, configure a pivoting roller pair 14. The pivoting roller 14*a* in a lowered position presses a sheet against the pinch roller 14*b*. A chuck lever 3*a* for pinching a trailing end of stacked sheets is disposed on a sheet conveying direction upstream side of the sheet placing stand 300*a*. The chuck lever 3*a* operates to hold the trailing end of the sheets according to the actuation of a not-shown solenoid and release the held trailing end of the sheets.

In addition to performing a linear motion in the horizontal direction, the sheet placing stand 300*a* can also be configured telescopic to be fit in below the conveying path, i.e., below the outlet rollers 2 and the inlet rollers 1. In other words, when sheets are stacked and supported on the sheet placing stand 300*a*, the sheet placing stand 300*a* is stretched in the sheet conveying direction and, when the sheets are dropped onto the processing tray, the sheet placing stand 300*a* is stored while retracting in a position below the conveying path. Details of the telescopic configuration are not described here because the well-known technique can be used. The telescopic configuration is suitable because a reduction in size of the entire sheet processing apparatus can be realized. A paddle 305 is provided above the processing tray 4.

A method of stacking three sheets on the sheet placing unit 300 provided as the sheet waiting unit that temporarily puts a sheet conveyed from the imaging forming apparatus on standby is explained below with reference to FIG. 16 and FIGS. 17A to 17L.

Figure 16:
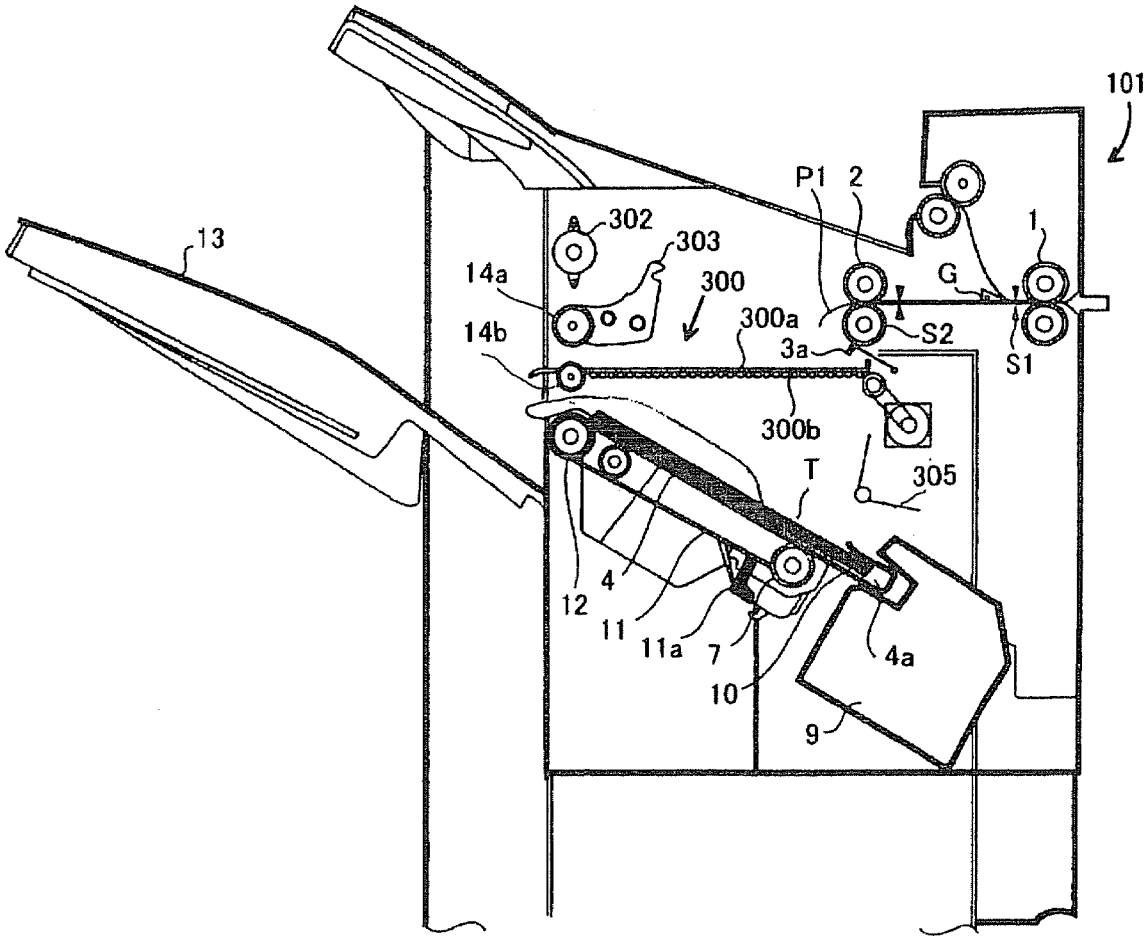
FIG. 16 is a diagram for explaining a state at the time when a first sheet is conveyed to a sheet placing unit anew.

FIG. 16 is a diagram showing a state in which a first sheet is conveyed to the sheet placing unit 300 anew. When a first sheet P1 is conveyed to the sheet placing unit 300 anew, a preceding sheet bundle T being subjected to finishing is stacked on the processing tray 4. The sheet P1 is prohibited from being discharged onto and stacked on the processing tray 4 and is buffered on the sheet placing stand 300*a*. FIGS. 17A to 17L are diagrams schematically showing a state until three sheets are stacked on the sheet placing unit 300.

First, when a leading end of the first sheet P1 discharged from the outlet rollers 2 is conveyed to near the pivoting roller 14*a*, a pivoting-roller opening and closing magnet (not shown) is actuated to lift the pivoting roller 14*a* in an UP direction to a lifted position. This is for the purpose of preventing the leading end of the first sheet P1 conveyed to the pivoting roller 14*a* from colliding with the pivoting roller 14*a* (see FIG. 17A). At this point, the pivoting roller 14*a* is rotating in the conveying direction.

Figure 17A:
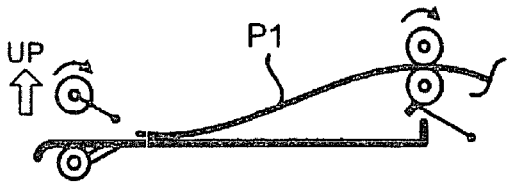
FIGS. 17A to 17L are diagrams for schematically explaining a state in which three sheets are placed on a sheet placing stand.
Figure 17B:
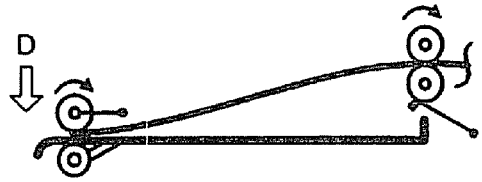
Figure 17C:
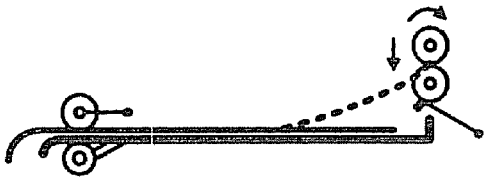
Figure 17D:
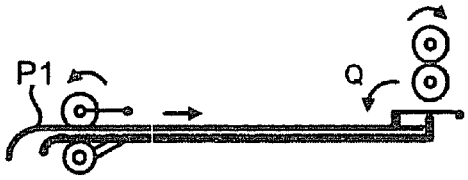
Figure 17E:
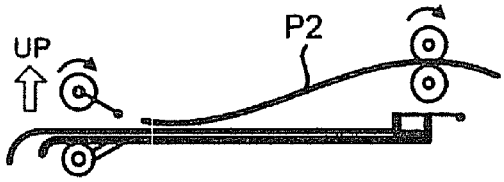
Figure 17F:
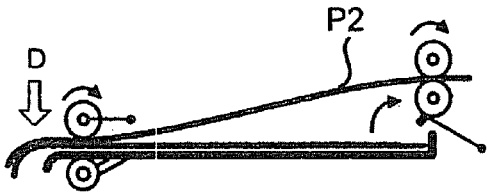
Figure 17G:
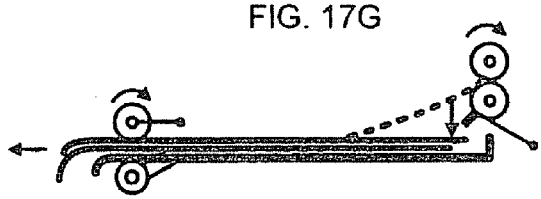
Figure 17H:
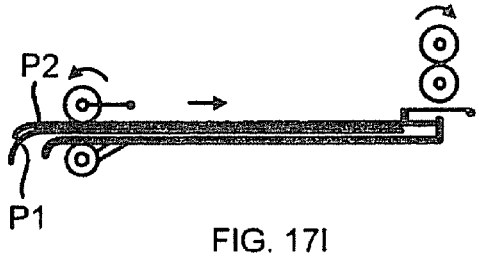
Figure 17I:
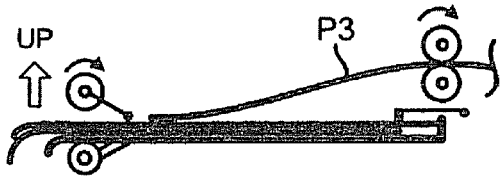
Figure 17J:
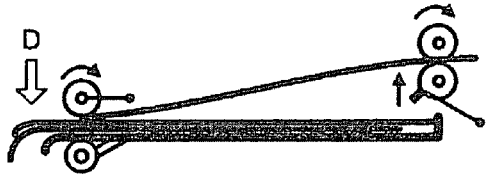
Figure 17K:
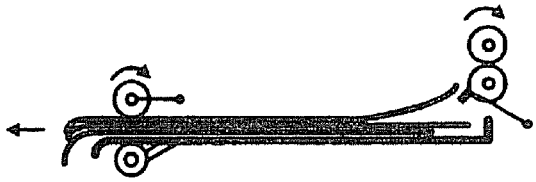
Figure 17L:
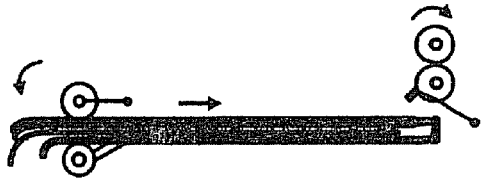

When the sheet P1 is conveyed to substantially right below the pivoting roller 14*a*, the pivoting roller 14*a* is lowered in a D direction (see FIG. 17B).

Since the pivoting roller 14*a* is rotating in the conveying direction, the sheet P1 nipped by the pivoting roller 14*a* and the pinch roller 14*b* is further conveyed and discharge of the sheet P1 from the outlet rollers 2 is completed. The entire sheet P1 is stacked on the sheet placing unit 300. At the same time, the rotation of the pivoting roller 14*a* is stopped (see FIG. 17C).

After stacking the sheet P1, the pivoting roller 14*a* is reversely rotated by about several pulses (e.g., 1 to 5 pulses) to switch back to convey the sheet P1 in a sheet trailing end side end direction of the sheet placing stand 300*a*. Then, an electromagnetic solenoid ES or the like is actuated to pivot the chuck lever 3*a* in an arrow Q direction to hold a trailing end of the first sheet P1. Stacking of the first sheet P1 on the sheet placing unit 300 is completed (see FIG. 17D). The switchback conveyance is performed for securing a margin for holding (chucking) the trailing end of the sheet P1.

When a leading end of a second sheet P2 is conveyed to near the pivoting roller 14*a*, the pivoting-roller opening and closing magnet is actuated to lift the pivoting roller 14*a*, which nips the first sheet P1 on the sheet placing unit 300, to the lifted position. In this state, a pivoting motor is regularly rotated to rotate the pivoting roller 14*a* in the conveying direction (see FIG. 17E). This is for the purpose of preventing the second sheet P2 from being jammed even if the second sheet P2 collides with the pivoting roller 14*a*. At this point, the trailing end of the first sheet P1 stacked on the sheet placing unit 300 earlier is held by the chuck lever 3*a* and the pivoting roller 14*a* is rotating in the conveying direction but is in the lifted position. Therefore, the first sheet P1 is not conveyed.

Thereafter, before the second sheet P2 is discharged from the outlet rollers 2 and stacking of the second sheet P2 on the sheet placing unit 300 is completed, the trailing end of the first sheet P1 held by the chuck lever 3*a* is released when predetermined time elapses after the leading end of the second sheet P2 passes the sheet detection sensor S2. At timing when the leading end of the second sheet P2 reaches a predetermined position, e.g., a position shifted by 10 mm to the conveying direction upstream side from the leading end of the first sheet P1, the pivoting roller 14*a* in the lifted position is lowered in the arrow D direction while being kept rotating in the conveying direction (see FIG. 17F).

According to this operation, the second sheet P2 is conveyed while a state in which the first sheet P1 is shifted further to the leading end side than the second sheet P2 (precedes in the conveying direction) is kept. A pulse of a pulse motor PM that conveys the second sheet P2 is counted. At timing when a difference between the leading ends of the two sheets reaches 10 mm, the pivoting roller 14*a* in rotation is lowered to nip the second sheet P2. Until discharge of a trailing end of the second sheet P2 from the outlet rollers 2 is completed, the first sheet P1 and the second sheet P2 are simultaneously conveyed in a downstream direction by the pivoting roller 14*a* (see FIG. 17G).

After the completion of the discharge of the sheet P2 by the outlet rollers 2, the rotation of the pivoting roller 14*a* is stopped and the outlet rollers 2 are reversely rotated by several pulses to switch back to convey the two sheets P1 and P2 to a sheet trailing end side of the sheet placing stand 300*a*. Then, like the first sheet P1, the trailing end of the second sheet P2 is held by the chuck lever 3*a* (see FIG. 17H).

As described above, the leading ends and the trailing ends of the positionally shifted two sheets are held and stacking of the sheets on the sheet placing unit 300 is completed.

When a leading end of a third sheet P3 is conveyed to near the pivoting roller 14*a*, the pivoting-roller opening and closing magnet is actuated to lift the pivoting roller 14*a*, which presses the first and second sheets P1 and P2 on the sheet placing unit 300, to the lifted position. In this state, the pivoting motor is regularly rotated to rotate the pivoting roller 14*a* in the conveying direction (see FIG. 17I).

At this point, the trailing ends of the first and second sheets P1 and P2 stacked on the sheet placing unit 300 earlier are held by the chuck lever 3*a* and the pivoting roller 14*a* is rotating in the conveying direction but is in the lifted position. Therefore, the first and second sheets P1 and P2 are not conveyed.

Before a trailing end of the third sheet P3 is discharged from the outlet rollers 2 and stacking of the third sheet P3 on the sheet placing unit 300 is completed, i.e., when the leading end of the second sheet P2 and the leading end of the third sheet P3 generally overlap according to counting of a pulse of the pulse motor PM that drives the outlet rollers 2, the pulse motor PM is stopped. The chuck lever 3*a* is released and the pivoting roller 14*a* in the lifted position is lowered in the arrow D direction while being kept rotating in the conveying direction (see FIG. 17J). At this point, since the pivoting roller 14*a* is rotating in the conveying direction, the sheets are sent downstream. However, the rotation of the pivoting roller 14*a* is stopped after several pulses elapse.

According to this operation, the third sheet P3 overlaps the second sheet P2 with leading end positions thereof aligned while the shifted positional relation of the first and second sheets P1 and P2 is unchanged.

As a stacking shift amount of the three sheets on the sheet placing unit 300, the first sheet P1 is in a position most preceding to the conveying direction downstream side and the second and third sheets P2 and P3 are located in a position shifted upstream by about 10 mm from that position. The respective sheets are conveyed while being pressed on the sheet placing unit 300 by the pivoting roller 14*a* in this positional relation (see FIG. 17K).

After discharge of the sheet P3 is completed, the rotation of the pivoting roller 14*a* is stopped. The pivoting roller 14*a* is reversely rotated to switch back and convey the sheet P3 and stops. The three sheets are stacked on the sheet placing unit 300 while the positional shift of the leading ends thereof is kept (see FIG. 17L).

When the following fourth sheet conveyed to the pivoting roller 14*a* is also put on standby, the fourth sheet only has to be processed in the same process as the stacking of the three sheets.

Figure 18A:
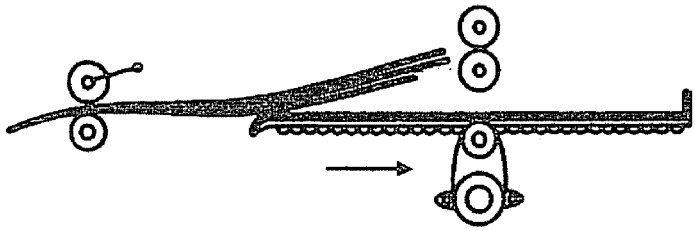
FIGS. 18A to 18C are diagrams for schematically explaining a state in which sheets placed on the sheet placing stand fall onto a processing tray.
Figure 18B:
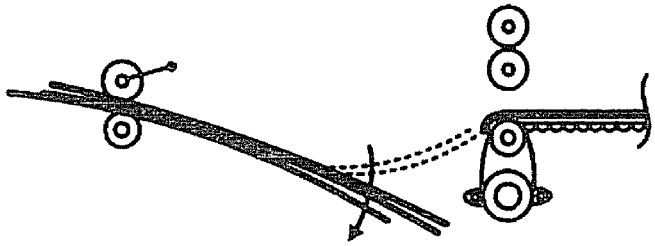
Figure 18C:
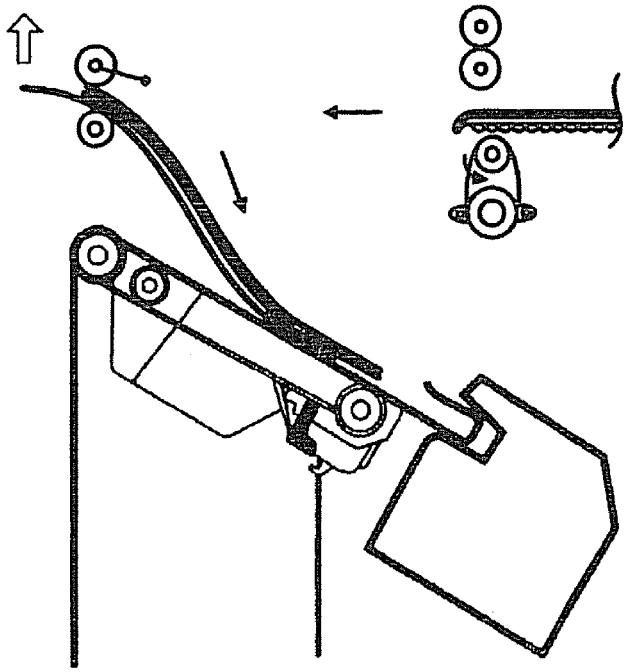

Processing for dropping and feeding sheets stacked on the sheet placing unit 300 to the processing tray 4 is explained. FIGS. 18A to 18C are diagrams for schematically explaining a state of the drop and feeding of the sheets.

The sheet placing unit 300 is configured to linearly move in the horizontal direction. Therefore, when there is no following sheet to be stacked on the sheet placing stand 300*a*, the sheet placing stand 300*a* is moved to the outlet rollers 2 side (see FIG. 18A). Since a trailing end of the sheets is not held by the chuck lever 3*a*, it is likely that the trailing end slightly rises from the sheet placing stand 300*a* during the movement of the sheet placing stand 300*a*. Since a leading end side of the sheets is nipped by the pivoting roller 14*a* and the pinch roller 14*b*, the stacked sheets do not come loose.

When the sheet placing stand 300*a* is completely moved, trailing ends of the three sheets hand down with own weight thereof (see FIG. 18B).

When the pivoting roller 14*a* is switched to the lifted position and the nip of the sheets is released, the three sheets fall, starting from the handing-down trailing end of thereof, on the processing tray 4 arranged below the sheet placing unit 300, slide on an upper surface of the processing tray 4, and are aligned with a sheet rear end positioning section 4*a* of the processing tray 4. When the sheets fall, the paddle 305 is pivoted to align a sheet at the top (see FIG. 18C). Therefore, since the sheets dropped and fed to the processing tray 4 fall on the processing tray 4 starting from the trailing end of thereof, longitudinal alignability on the processing tray 4 is satisfactory. When the fourth sheet or a sheet that does not need to be buffered is continuously conveyed to the pivoting roller 14*a*, the sheet placing stand 300*a* is returned to a home position on the pivoting roller pair 14 side. As described above, the sheet placing stand 300*a* is moved to the outlet rollers 2 side to drop and feed the sheet to the processing tray 4 while the following sheet is nipped by the pivoting roller pair 14 (see FIG. 18A). When a sheet at the bottom (a first sheet) stacked on the processing tray 4 is longitudinally aligned, actions and effects same as those in the first embodiment are obtained.

In this embodiment, the switchback conveyance is performed for the purpose of securing a margin for holding (chucking) a trailing end of a sheet before holding the trailing end. However, it goes without saying that, when the holding of the trailing end can be realized without the switchback conveyance by appropriately selecting a shape and dimensions of the chuck lever 3*a*, the switchback conveyance may be omitted. In this embodiment, the sheet placing stand 300*a* of the sheet placing unit 300 is horizontally set. However, according to a height position of a sheet discharge unit of the image forming apparatus 200, the arrangement of the inlet rollers 1 and the outlet rollers 2 of the sheet processing apparatus 101 may be changed to arrange the sheet placing unit 300 to be tilted such that a trailing end side of a sheet is in a position lower than a leading end of the sheet. In the second embodiment, for improvement of processing performance and alignability of the sheet processing apparatus 101, it is effective to increase or decrease the number of buffered sheets on the sheet placing unit 300 on the basis of predetermined sheet interval time.

Third Embodiment

When speed of handling of sheets in the sheet processing apparatus 100 is increased, an amount of charges of the sheets increases and the sheets stick together when, for example, the sheets are conveyed onto the waiting tray 3 and fall onto the processing tray 4. It is likely that the sheets do not move to an intended position.

In order to avoid deficiency in a processing step, sheets stacked on the waiting tray 3 are required not to be charged. Therefore, it is desirable to surely remove charges before the sheets are conveyed through the waiting tray 3.

In order to cope with presence or absence of finishing and content of the finishing, in a sheet processing apparatus according to a second embodiment, plural sheet conveying paths are prepared as described above. It is desired to surely remove charges before sheets are stacked on the waiting tray 3 regardless of through which of the paths the sheets are conveyed.

Figure 19:
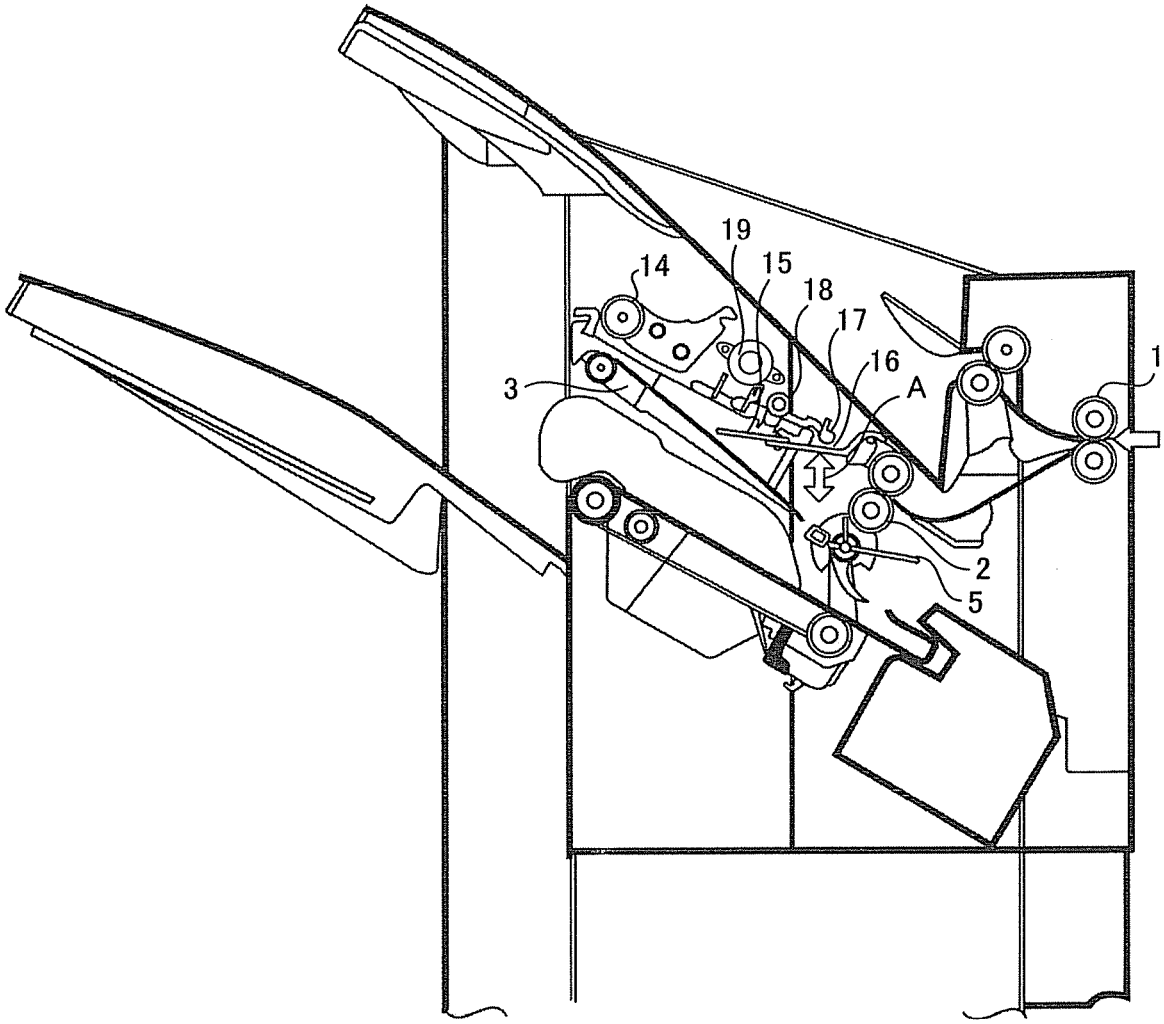
FIG. 19 is a diagram showing the vicinity of a charge removing brush of the sheet processing apparatus.

A charge removing member is explained with reference to FIG. 19. As shown in FIG. 19, a paper bias arm 16 as sheet pushing member that can change a state of contact with a sheet is disposed downstream of the exit rollers 2. The paper bias arm 16 plays a role of smoothing conveyance of sheets delivered from the exit rollers 2. The paper bias arm 16 is formed of a conductive member (e.g., a stainless steel plate material). The paper bias arm 16 is pivotable in an up and down direction indicated by an arrow A via a cam follower arm 17 cam-driven by rotational driving of an assist arm motor 19 shown in FIG. 19.

Moreover, a charge removing member 15 is attached to one end located downstream in the conveying direction of the paper bias arm 16. As the charge removing member 15, for example, a member formed by intertwining extremely thin stainless steel wires and bounding the intertwined stainless steel wires in a brush shape is suitable. The waiting tray 3 is located below the paper bias arm 16.

When a sheet is nipped and conveyed by the exit rollers 2, the sheet is rubbed to be charged. Therefore, the sheet delivered from the exit rollers 2 is guided to the paper bias arm 16 and conveyed while touching the charge removing member 15.

An operation of the paper bias arm 16 when sheets are stacked on the waiting tray 3 is explained. A cam (not shown) is rotated to swing the cam follower arm 17 by rotating the paper bias arm motor 19. The paper bias arm 16 is lifted in an upward arrow direction in FIG. 19 and pivoted by the swing of the cam follower arm 17. A rotation angle position of the cam is detected by using a cam sensor slit 18.

The paper bias arm 16 configured to be pivotable stops in three positions, i.e., (1) a standby position, (2) a charge removing position, and (3) a pressing position. The standby position is an uppermost position. The paper bias arm 16 is located in the standby position until a leading end of a sheet is caught by the pivoting rollers 14. The charge removing position is an intermediate position. In the case of straight paper discharge not requiring finishing, the paper bias arm 16 is located in the charge removing position.

The pressing position is a lowermost position. When a sheet is stacked on the waiting tray 3, the paper bias arm 16 moves to the pressing position when a trailing end of the sheet passes through the exit rollers 2. When the sheet is stacked on the waiting tray 3, the paper bias arm 16 presses the sheet on the waiting tray 3 to prevent the sheet from floating or flapping.

After the stacking on the waiting tray 3 is completed, a waiting tray driving motor (not shown) is normally rotated, the paddle 5 is operated while opening and moving the waiting tray 3 in the lateral direction of sheets, and the sheets are dropped onto the processing tray 4. When the waiting tray 3 opens in a direction orthogonal to the conveying direction, the sheet drop is assisted by sturdiness of the charge removing member 15.

According to this embodiment, a posture of the paper bias arm 16 can be held at an arbitrary angle. Therefore, for example, it is possible to extensively cope with information concerning types of sheets sent from the image forming apparatus 200. Even during sheet conveyance, the posture of the paper bias arm 16 can be changed. Therefore, it is possible to cope with a state of sheets. Moreover, it is possible to surely rub the charge removing member 15 against sheets and remove charges of the sheets without relying on a sheet conveying route.

Fourth Embodiment

The paddle 5 for patting sheets and longitudinally aligning the sheets when the sheets are dropped from the waiting tray 3 onto the processing tray 4 is explained.

Figure 20:
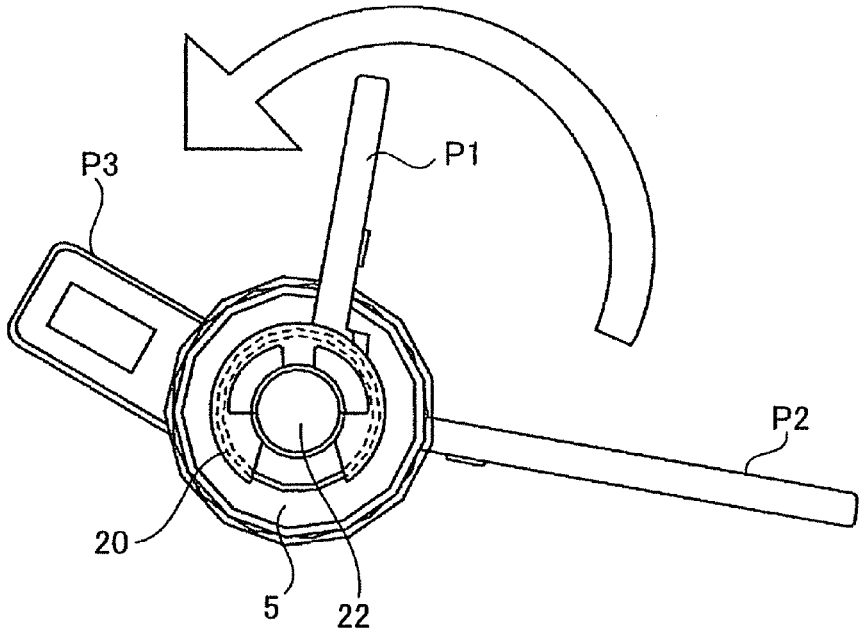
FIG. 20 is a diagram for explaining an operation of a paddle.

FIG. 20 is a diagram of the paddle 5 viewed from a side. The paddle 5 plays a role of patting, when sheets stacked on the waiting tray 3 are dropped onto the processing tray 4 (in a third embodiment, referred to as active drop), a trailing end of the sheets to prevent scattering of the sheets during the drop and quickly longitudinally aligning the patted-down sheets on the processing tray 4. Therefore, for improvement of performance, it is necessary to rotate the paddle 5 at high speed.

Therefore, in order to reduce impact sound caused when the sheets are patted, whizzing sound caused when the paddle 5 rotates energetically, and the like, in this embodiment, the rotation of the paddle 5 is controlled to be optimum.

As shown in FIG. 20, the paddle 5 includes a spool 20 as a rotor axially supported by a paddle shaft 22, a short paddle P1 attached to the spool 20, and a long paddle P2. Both the paddles P1 and P2 are formed of an elastic body not to damage the sheet P even if the paddles P1 and P2 come into contact with the surface of the sheet P. It is possible to pat down sheets from the waiting tray 3 onto the processing tray 4 using the short paddle P1. It is possible to longitudinally align the sheets dropped onto the processing tray 4 using the long paddle P2. The disposed paddle 5 is not limited to one paddle. Plural paddles may be disposed in parallel at a predetermined interval according to a size of sheets to be treated. In this embodiment, two paddles in total, i.e., the paddles P1 and P2 are disposed.

The paddle 5 configured in this way is controlled to rotate by pulse management of a paddle motor. First, the paddle motor is normally rotated and a driving force is transmitted to the paddle shaft 22 to rotate the spool 20.

Figure 21:
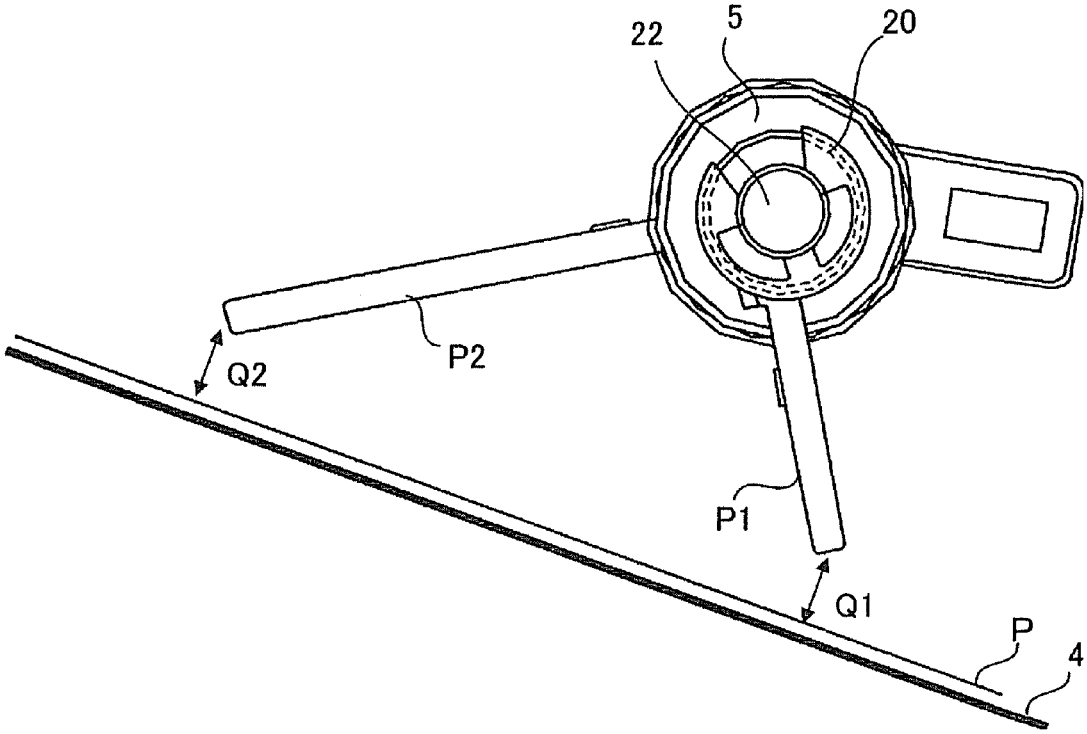
FIG. 21 is a diagram for explaining an operation of the paddle.

FIG. 21 is a diagram for explaining suspension control during the rotation of the paddle 5.

Figure 22:
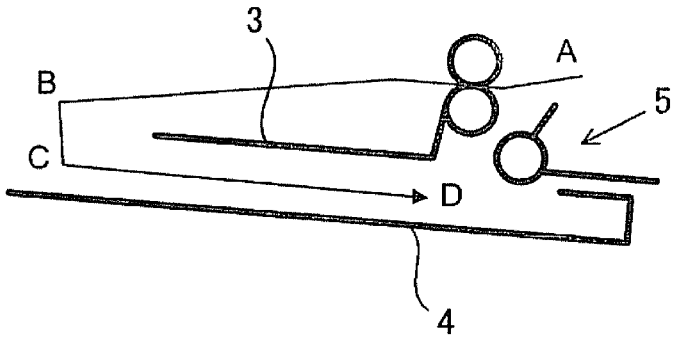
FIG. 22 is a diagram for explaining an operation of the paddle.

A pulse of the paddle motor is counted to control a rotation angle of the paddle shaft 22. Sheets are patted down from the waiting tray 3 onto the processing tray 4 by the short paddle P1 and, then, the paddle 5 is suspended. As shown in FIG. 22, the rotation of the paddle 5 is suspended in a position where a predetermined space Q2 is kept between the surface of the sheets P on the processing tray 4 and the long paddle P2. The number of the sheets P stacked on the processing tray 4 varies depending on content of finishing set by a user. However, since the number of the sheets P is separately counted, the predetermined space Q2 is a distance for preventing the long paddle P2 from coming into contact with the surface of the sheets P. A space Q1 between the short paddle P1 and the surface of the sheets P is controlled to have a relation $Q1 \leqq Q2$. However, when the number of stacked sheets P increases, the relation changes to $0 \leqq Q1 < Q2$. The rotation of the paddle 5 is suspended in the position where the long paddle P2 does not come into contact with the surface of the sheets P in this way in order to prevent the long paddle P2 from interfering with the longitudinal alignment by the longitudinal alignment roller 7. Moreover, by suspending the paddle 5, it is possible to reduce noise involved in high-speed rotation of the paddle 5.

After the suspension, for example, after several milliseconds elapses, the rotation of the paddle 5 is resumed during the longitudinal alignment in which the longitudinal alignment roller 7 is rotating. According to such operation control, the sheets P dropped onto the processing tray 4 are drawn into the depth of the processing tray 4 by the long paddle P2 and the longitudinal alignment is surely performed.

Figure 23:
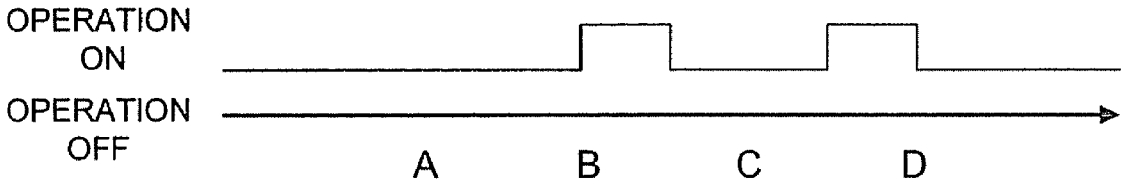
FIG. 23 is a diagram for explaining an operation of the paddle.

Timing of conveyance of sheets and a paddle operation is explaining. FIG. 22 is a schematic diagram of a conveyance locus on the processing tray 4 of a leading end of a sheet. FIG. 23 is a diagram for explaining a relation between ON/OFF control of a paddle pivoting operation and a leading end position of a sheet. In FIGS. 22 and 23, A indicates a position further on an upstream side of conveyance than the exit rollers 2, B indicates a leading end position of a sheet on the waiting tray 3, C indicates a leading end position of the sheet on the processing tray 4, and D indicates, for example, a staple position.

After a sheet is conveyed from a position A to a position B by conveying mechanism and dropped and stacked on the waiting tray 3, the paddle motor is driven. As described above, according to this operation, the sheet is patted down onto the processing tray 4 by the short paddle P1. The sheet moves from the position B to a position C. When the long paddle P2 pivots to a position where the long paddle P2 does not come into contact with an upper surface of the sheet on the processing tray 4, the paddle shaft 22 stops the paddle motor. During this operation, the sheet on the processing tray 4 starts, with inertia, movement from the position C to a position D where stapling is possible. When the sheet on the processing tray 4 comes to a position where longitudinal alignment is possible, the paddle motor operation is started again. This series of operations is realized by, as shown in FIG. 23, controlling to turn on the pivoting operation of the paddle 5 in the movement from the position B to the position C and in the movement from the position C to the position D.

A longitudinal aligning force is given to sheets stacked on the processing tray 4. The longitudinal aligning force is given to sheets on an upper side by paddling of the paddle 5 and is given to sheets on a lower side by the longitudinal alignment roller 7. Therefore, a first sheet of the sheets stacked to be shifted on the waiting tray 3 is aligned by reversing a longitudinal aligning motor and reversely driving the longitudinal alignment roller 7. Second and third sheets are longitudinally aligned by the paddle 5 by normally rotating the paddle motor.

By locating the first sheet, to which a stable longitudinal aligning force is given by the longitudinal alignment roller 7, to be shifted further to downstream in the conveying direction than the second and third sheets, it is possible to give the longitudinal aligning force to the second sheet and then to the third sheet using paper friction.

As described above, the conveyance of the sheets to and the longitudinal alignment of the sheets on the processing tray 4 are realized by rotating the paddle 5 once.

According to this embodiment, it is possible to reduce impact sound caused when sheets are patted. Since the number of times of paddle rotation is reduced to one by suspending the paddle 5 before the paddle 5 is rotated once, even if sheets are supplied from the image forming apparatus 200 at high speed, processing time is not affected and the sheets can be aligned with sufficient time.

Fifth Embodiment

When a rotating member such as the paddle 5 is locked to a rotating shaft, in general, a groove is formed in the rotating shaft and a pin is inserted into the groove. Therefore, a gap is necessary between the groove and the pin according to a difference between dimensions of the gaps and the groove and a backlash occurs. Consequently, when the rotating member such as the paddle 5 rotates and pats sheets, impact and vibration occur to cause noise. Although it is attempted to set a tolerance between the groove and the pin as small as possible, there is a limit in manufacturing.

Therefore, in a fifth embodiment, a configuration for preventing a parallel pin used in locking the rotating member from flapping during the rotation operation of the paddle 5 is adopted.

Figure 24:
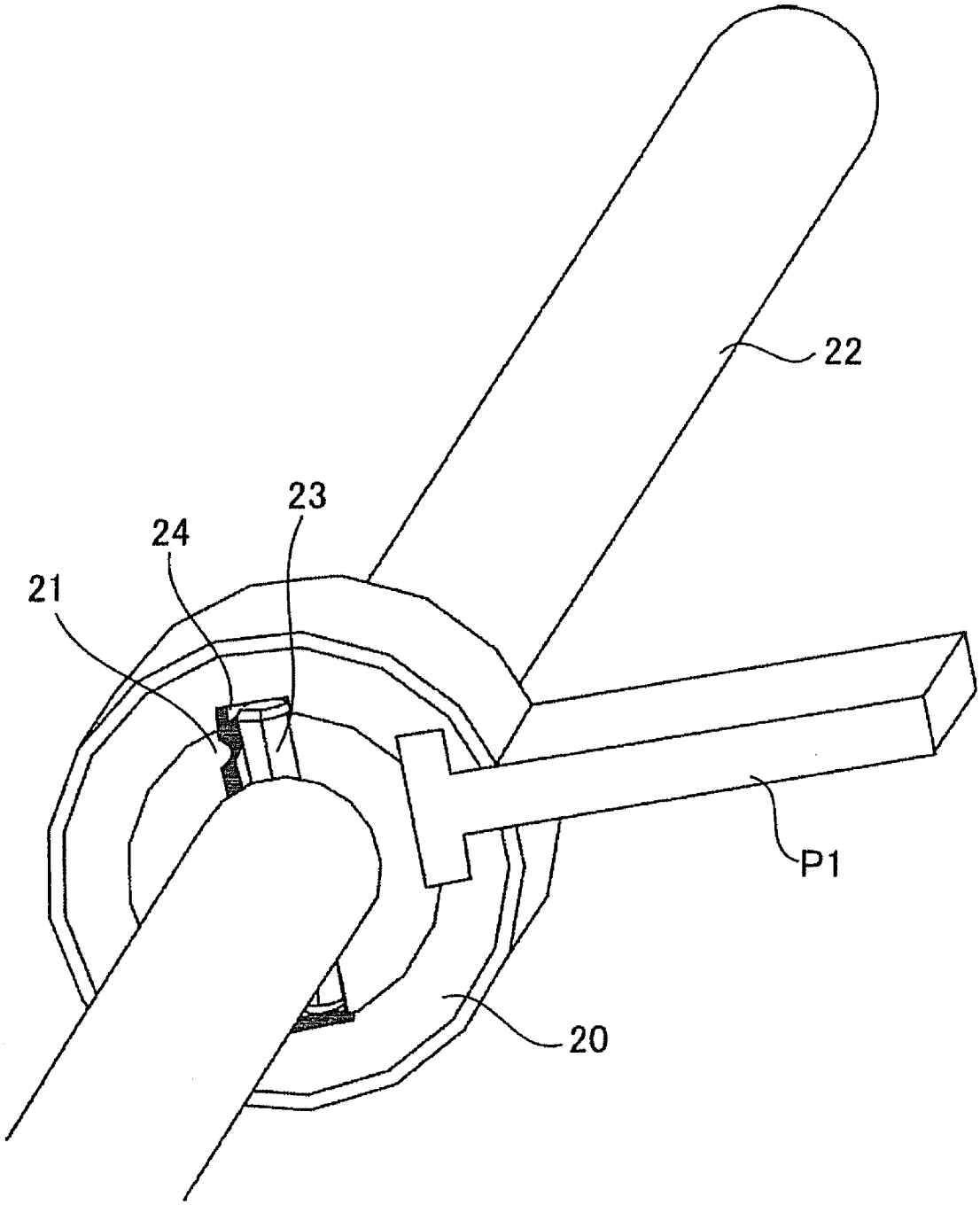
FIG. 24 is a perspective view of a locked spool.
Figure 25:
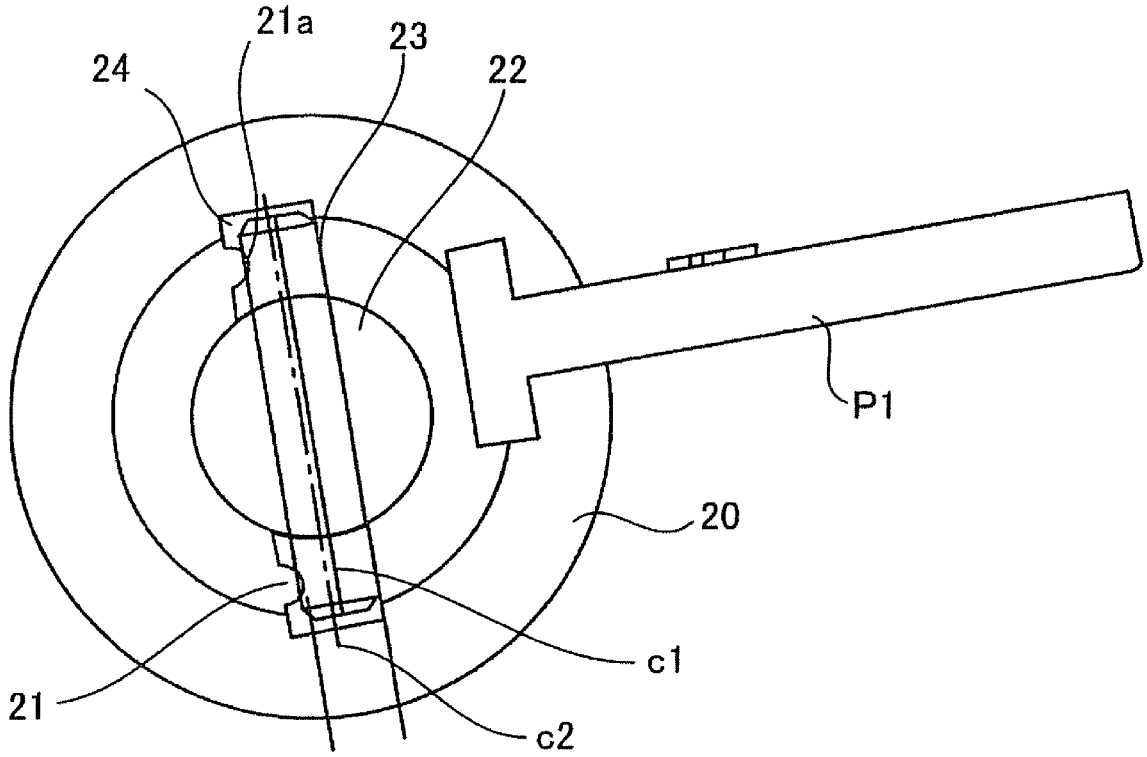
Figure 26:
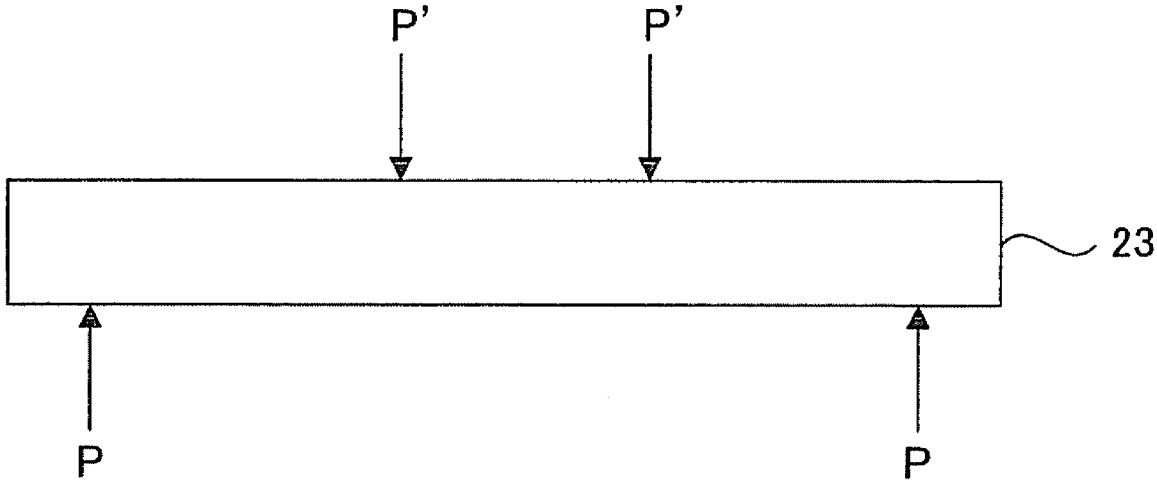
FIG. 26 is a diagram for explaining how a force is applied to the parallel pin.

Locking of the spool 20 of the paddle 5 performed by using the parallel pin 23 is explaining with reference to FIGS. 24 to 26.

FIG. 24 is a perspective view of the locked spool 20. As shown in FIG. 24, the shaft 22 loosely pierces through the center of the spool 20. The parallel pin 23 pierces through the center of the spool 20 passing near an axis of the shaft 22. A groove 24 in which the parallel pin 23 fits is formed in the center of the spool 20. Two projections 21 are formed in two places in the groove 24. A shape of the projections 21 is, for example, an angle shape.

FIG. 25 is a diagram showing a relation among the parallel pin, the shaft, the spool section groove, and the like.

As shown in FIG. 25, a dimension of the spool section groove 24 of the spool 20 is set to shift the center C1 of a hole of the shaft 22 and the center C2 of the spool section groove 24 from each other and the spool section groove 24 is formed. For example, the parallel pin 23 has a diameter $\phi 2$ and is made of stainless steel. The spool section groove 24 and the spool section projections 21 are integrally formed with the spool 20 and made of resin mold. A material of the shaft 22 is, for example, free-cutting steel.

As the parallel pin 23, a pin having hardness higher than that of the spool section projections 21 formed in the spool section groove 24 is selected.

A dimension from tops 21*a* of the projections 21 to a long side of the spool section groove 24 is set smaller than an outer diameter of the parallel pin 23, for example, set to 1.87±0.3 mm.

In such a configuration, one side of the parallel pin 23 is pressed against the shaft hole on a side along the long side of the spool section groove 24 of the spool 20 to insert the parallel pin 23. Then, since the projections 21 formed in the spool section groove 24 are crushed, the parallel pin 23 does not backlash. In the example described above, the projections 21 are crushed about 0.13 mm from the tops 21*a*.

A method of applying the force to the parallel pin 23 is explained. As shown in FIGS. 25 and 26, the parallel pin 23 is pressed by the side of the spool section groove 24 and, on the other hand, crushes the projections 21 formed in the two places. Therefore, an external force P acts on the parallel pin 23 from the projections 21 and an external force P' of the same magnitude acts from the other side of the parallel pin 23. Therefore, the forces acting on the parallel pin 23 are balanced to make it possible to eliminate a backlash.

In this way, not only the paddle 5 can be applied to a place where noise is likely to be caused by a backlash with the parallel pin 23.

According to this embodiment, a tolerance between the shaft 22 and the parallel pin 23 and a tolerance between the shaft 22 and the spool 20 can be loosely managed. Therefore, it is possible to realize sure loose fitting without deteriorating manufacturability of these components. Since the parallel pin 23 does not flap, it is possible to reduce vibration sound.

Sixth Embodiment

As described above, the waiting tray 3 drops the sheets onto the processing tray 4. The sheets may be stapled after longitudinal and lateral alignment. This is possible by driving the lateral alignment plate 6 and performing lateral alignment.

However, users desire various kinds of finishing and there is a need for sorting a relatively small number of sheets.

Therefore, in a sixth embodiment, it is possible to cope with finishing in which strict alignability is not required compared with stapling.

In this embodiment, it is possible to sort sheets on the waiting tray 3 without dropping the sheets onto the processing tray 4. As described above, it is possible to buffer three sheets at the maximum on the waiting tray 3. Therefore, three or less sheets can be sorted on the waiting tray 3 without dropping the sheets onto the processing tray 4. It is possible to cope with sorting of more than three stacked sheets by repeating the sorting by the waiting tray 3 in three-sheet units. For example, four to six sheets can be sorted by repeating the sorting twice and seven to nine sheets can be sorted by repeating the sorting three times.

Figure 27:
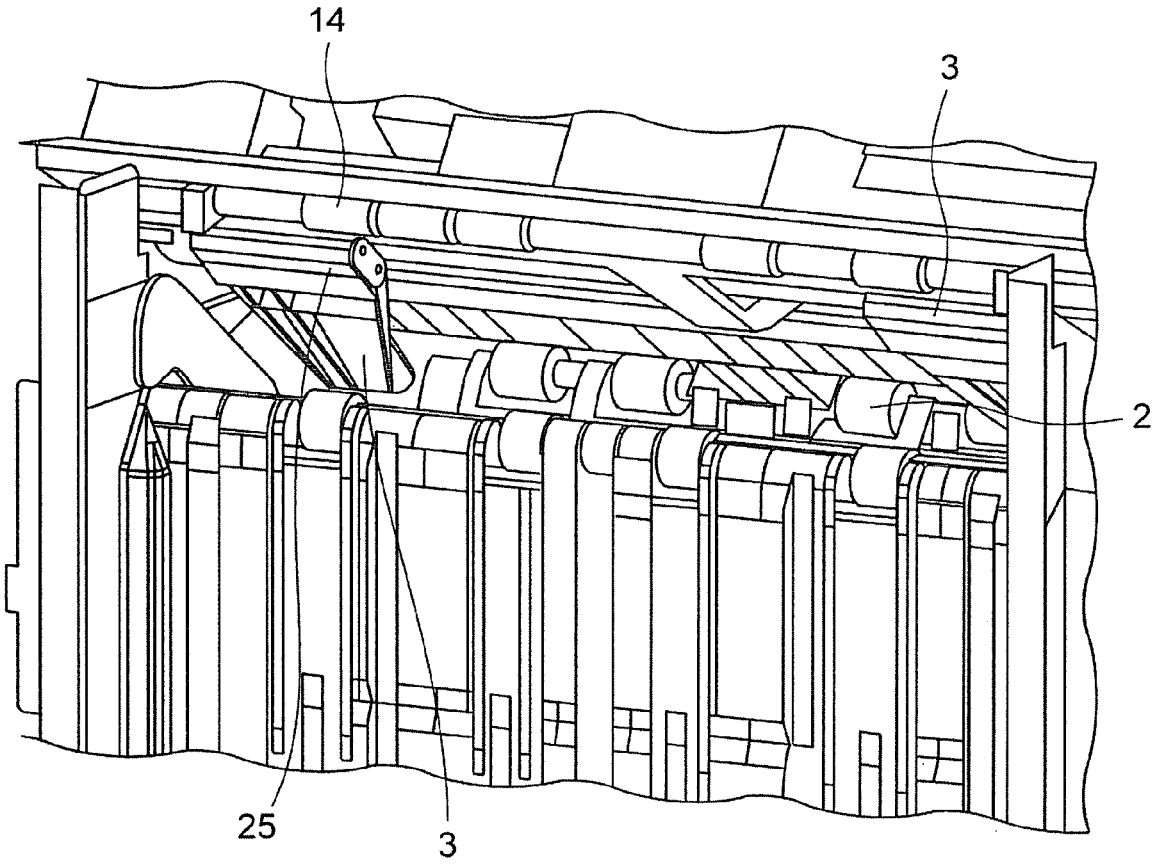
FIG. 27 is a perspective view showing the vicinity of a waiting tray.
Figure 28:
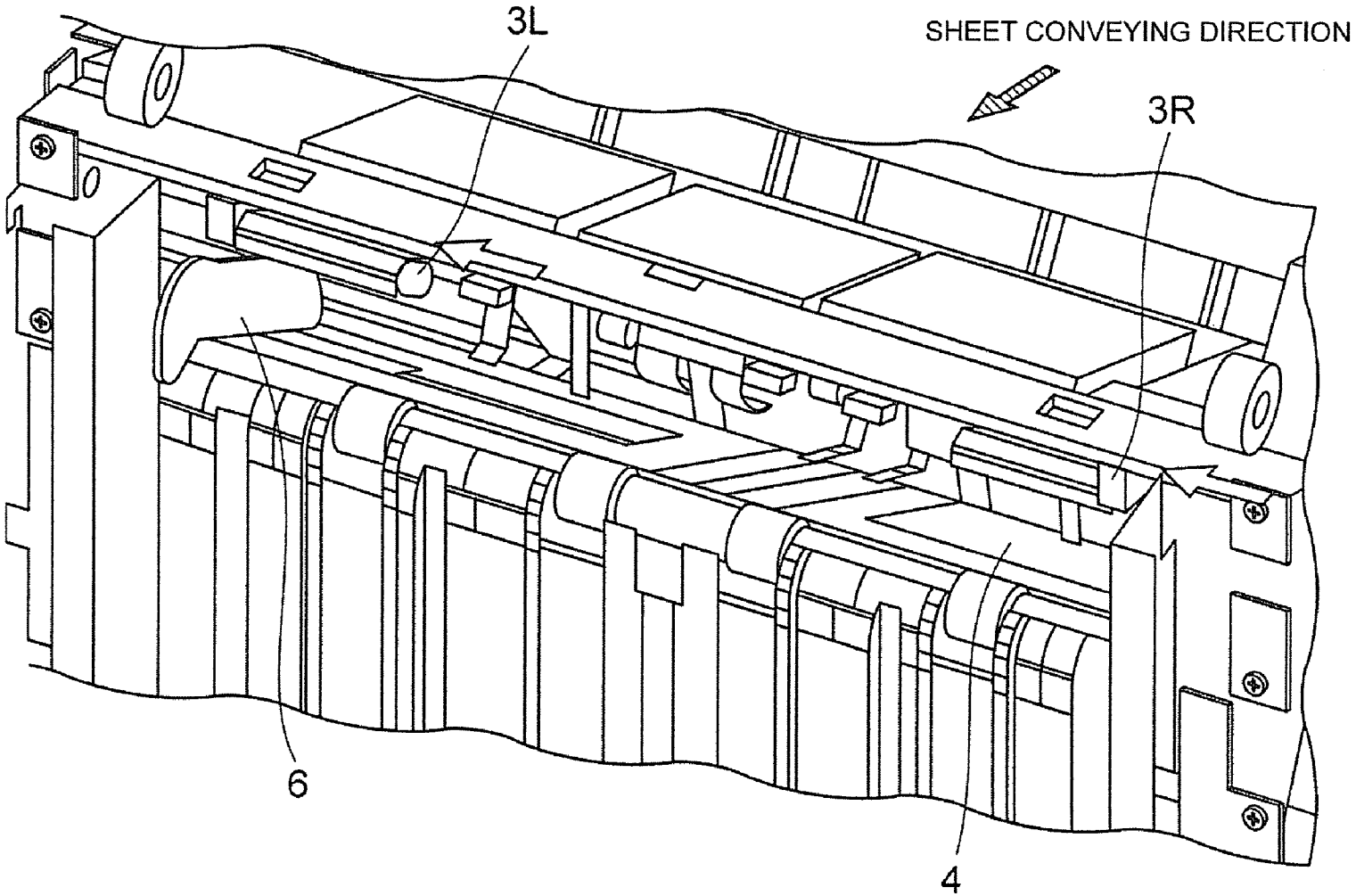
FIG. 28 is a perspective view for explaining the movement of the waiting tray during sorting.
Figure 29:
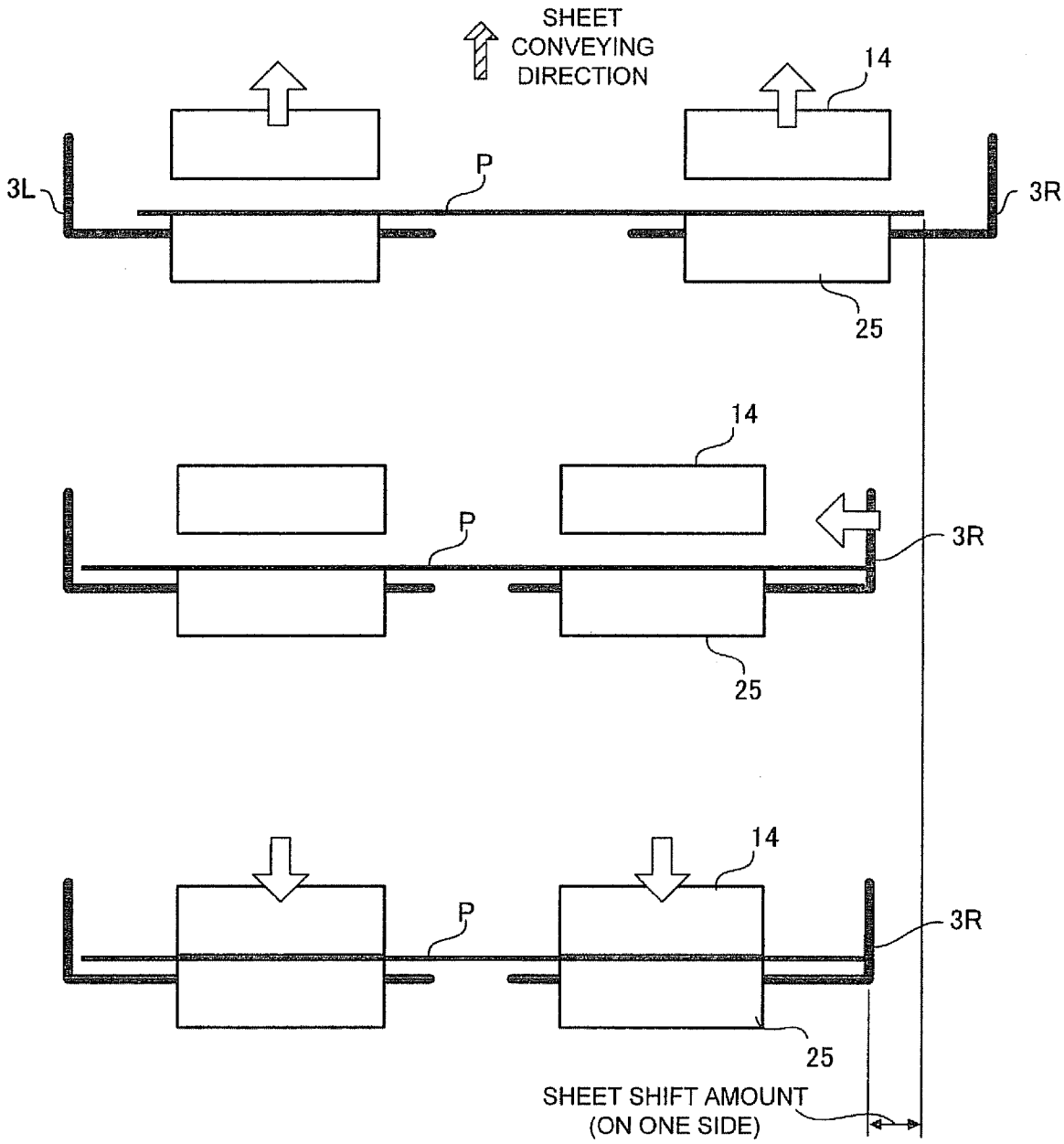
FIG. 29 is a diagram for explaining simple sorting by the waiting tray.

The sorting by the waiting tray 3 is explained below. The waiting tray 3 includes a pair of waiting tray sections, i.e., a waiting tray section 3L that supports sheets from a left side in a width direction of the sheets with respect to the conveying direction and a waiting tray section 3R that supports the sheets from a right side in the width direction. FIG. 27 is a perspective view showing the vicinity of the waiting tray 3. As shown in FIG. 27, a sheet that has passed through the exit rollers 2 is temporarily put on standby on the waiting tray 3 while being kept clamped by the pivoting rollers 14 and a waiting-tray pinch roller 25 (see FIG. 3). A pivoting magnet (not shown) is temporarily actuated from this state to release the clamping of the pivoting rollers 14. Then, the waiting tray driving motor is actuated to shift, for example, the waiting tray section 3R on the right side to the left side (in an arrow direction) in the figure by a specified amount as shown in FIG. 28. Consequently, it is possible to press an end of stacked sheets with a right side wall and shift the sheets to the left side. After the shift, the ends of the sheets are clamped by the pivoting rollers 14 again (see FIG. 29). Thereafter, the pivoting motor is normally rotated and the sheets subjected to sorting are discharged onto the stacking tray 13.

Moreover, it is possible to obtain a larger sort amount by not only moving the waiting tray section 3R on the right side but also moving the waiting tray section 3L on the left side away from the sheets to the left side. In the same manner, it is possible to shift the sheets by moving the waiting tray section 3L to the right side. It is possible to realize visually and physically identifiable offset discharge by switching moving directions of the waiting tray sections 3R and 3L in each print job and discharging the sheets.

According to this embodiment, it is possible to sort sheets on the waiting tray 3 without conveying the sheets to the processing tray 4. Therefore, it is possible to substantially reduce time required for sorting. Further, since the sheets are not patted, it is possible to reduce noise.

The present invention is not limited to the embodiments per se. At an implementation stage, it is possible to modify and embody the elements without departing from the spirit of the invention. It is possible to form various inventions by appropriately combining the plural elements disclosed in the embodiments. For example, several elements may be deleted from all the elements disclosed in the embodiments. The elements disclosed in the different embodiments may be appropriately combined.

What is claimed is:

1. A sheet processing apparatus comprising:

a processing tray on which plural sheets are stacked and subjected to finishing;

a sheet waiting unit configured to be provided along a conveying path to convey the sheets to the processing tray;

a sheet placing member that is provided in the sheet waiting unit and on which the sheets are placed;

a rotor that is provided above in a conveying direction downstream side of the sheet waiting unit and supported to be capable of rising and falling and controlled to rotate in a sheet conveying direction during rotation in the lifted position, rotate to press the sheets in the lowered position, convey the sheets while keeping the positional shift, and press the sheets placed on the sheet waiting unit without rotating;

a switching member that switches the rotor to a lifted position and a lowered position; and a driving source that pivots the rotor and conveys the sheets, wherein the sheet processing apparatus drives the switching member and the driving source and controls a sheet feeding operation by the rotor and places, in the plural sheets stacked on the sheet waiting unit, leading ends of second and subsequent sheets and aligns the leading ends with a position shifted a predetermined distance to a conveying direction upstream side from a leading end of a first sheet.

2. A sheet processing apparatus according to claim 1, wherein the sheet processing apparatus temporarily puts, during processing work in the processing tray or during discharge conveyance of sheets after finishing, plural sheets conveyed for finishing anew on standby on the sheet waiting unit on which the sheets can be put on standby.

3. A sheet processing apparatus according to claim 1, wherein the sheet placing member moves in a sheet support releasing direction, whereby the sheets fall onto the processing tray arranged below the sheet waiting unit.

4. A sheet processing apparatus according to claim 1, wherein the leading end of the first sheet precedes in a sheet conveying direction, the predetermined distance of the positional shift of the placed sheets is set to 5 to 20 mm, and a sheet holding member that presses trailing ends of second and subsequent sheets against the sheet placing member and holds the trailing ends while keeping the positional shift is provided in the sheet waiting unit.

5. A sheet processing apparatus according to claim 1, wherein, when the sheets are put on standby on the sheet waiting unit and it is unnecessary to put following sheets conveyed for finishing on standby, after dropping the sheets buffered on the sheet placing member onto the processing tray, the sheet processing apparatus temporarily places the following sheets on the sheet placing member and, then, drops the following sheets onto the processing tray one by one.

6. A sheet processing apparatus according to claim 1, further comprising:

a waiting tray that is provided in the sheet waiting unit and includes a pair of supporting members on which sheets are placed; and a driving source that moves the pair of supporting members of the processing tray in a sheet support releasing direction, wherein the sheet processing apparatus controls the driving source to move the supporting members in a direction orthogonal to a sheet conveying direction and drop plural sheets placed on the waiting tray onto the processing tray provided below the sheet waiting unit.

7. A sheet processing apparatus according to claim 6, wherein the waiting tray is disposed to be inclined to be lower on an upstream side than a downstream side with respect to the sheet conveying direction.

8. A sheet processing apparatus according to claim 6, wherein, when four or more sheets are subjected to finishing, after dropping three sheets buffered on the waiting tray onto the processing tray, the sheet processing apparatus temporarily places the following sheets on the waiting tray and, then, drops the following sheets onto the processing tray one by one.

9. A sheet processing apparatus according to claim 6, wherein, when the sheets are put on standby on the sheet waiting unit and it is unnecessary to put following sheets conveyed for finishing on standby, after dropping plural sheets buffered on the waiting tray onto the processing tray, the sheet processing apparatus temporarily places the following sheets on the waiting tray and, then, drops the following sheets onto the processing tray one by one.

10. A sheet processing apparatus according to claim 6, wherein the sheet processing apparatus controls a number of sheets buffered on the waiting tray according to sheet interval time of sheets supplied from the image forming apparatus.

11. A sheet processing apparatus according to claim 6, wherein, when a third sheet is not supplied from the image forming apparatus when predetermined time elapses after first and second sheets supplied from the image forming apparatus are buffered on the waiting tray, the sheet processing apparatus drops the two sheet being buffered on the waiting tray onto the processing tray if sheet processing on the processing tray is completed.

12. A sheet processing apparatus according to claim 6, wherein, when a third sheet is supplied from the image forming apparatus within predetermined time after first and second sheets supplied from the image forming apparatus are buffered on the waiting tray, the sheet processing apparatus also buffers the third sheet on the waiting tray.

13. A sheet processing apparatus comprising:

a processing tray on which plural sheets conveyed from an image forming apparatus are stacked and subjected to finishing;

a sheet placing member that is provided along a conveying path to convey the sheets to the processing tray;

a rotor that is provided above in a conveying direction downstream side of the sheet placing member and supported to be capable of rising and falling and controlled to rotate in a sheet conveying direction during rotation in the lifted position, rotate to press the sheets in the lowered position, convey the sheets while keeping the positional shift, and press the sheets placed on the sheet waiting unit without rotating;

a nipping member that is provided on a conveying direction upstream side of the sheet placing member and holds or releases a trailing end of the sheets placed on the sheet placing member;

a switching member that switches the rotor to a lifted position and a lowered position; and a driving source that pivots the rotor and conveys the sheets, wherein the sheet processing apparatus drives the switching member, the nipping member, and the driving source to control a sheet feeding operation by the rotor and places, among the plural sheets stacked on the sheet placing member, leading ends of second and subsequent sheets and aligns the leading ends with a position shifted a predetermined distance to the conveying direction upstream side from a leading end of a first sheet.

14. A sheet processing apparatus according to claim 13, wherein the sheet placing member moves in a direction to release support of the sheets and drops the sheets placed thereon onto the processing tray.

* * * * *